US007047778B2

(12) United States Patent
Dimig et al.

(10) Patent No.: US 7,047,778 B2
(45) Date of Patent: May 23, 2006

(54) VEHICULAR LOCK APPARATUS AND METHOD

(75) Inventors: Steven J. Dimig, Plymouth, WI (US); Keith D. Zirtzlaff, Port Washington, WI (US); Alan J. Ritz, Brookfield, WI (US); Thomas J. Green, West Bend, WI (US); Scott H. Micoley, Cedarburg, WI (US); Scott G. Klos, Grafton, WI (US); Brian J. Munzel, Port Washington, WI (US); Alexandre Y. Reikher, Milwaukee, WI (US); Lucas J. Boesel, Milwaukee, WI (US); Larry R. Grimmer, Sussex, WI (US); Russell J. Winberg, Wauwatosa, WI (US)

(73) Assignee: Strattec Security Corporation, Milwaukee, WI (US)

( * ) Notice: Subject to any disclaimer, the term of this patent is extended or adjusted under 35 U.S.C. 154(b) by 4 days.

(21) Appl. No.: 10/336,250

(22) Filed: Jan. 3, 2003

(65) Prior Publication Data

US 2003/0154753 A1 Aug. 21, 2003

Related U.S. Application Data

(60) Provisional application No. 60/345,631, filed on Jan. 3, 2002.

(51) Int. Cl.
*E05B 27/00* (2006.01)

(52) U.S. Cl. ..... 70/495; 70/496; 70/337; 70/384

(58) Field of Classification Search ..... 70/382–385, 70/365, 366, 492, 495, 337–343, 496
See application file for complete search history.

(56) References Cited

U.S. PATENT DOCUMENTS

| | | | | |
|---|---|---|---|---|
| 2,603,081 | A | 7/1952 | Pelle | |
| 2,895,323 | A * | 7/1959 | Kennedy | 70/383 |
| 3,125,878 | A | 3/1964 | Gutman | |
| 3,172,284 | A | 3/1965 | Crandell et al. | |
| 3,175,379 | A | 3/1965 | Russell et al. | |
| 3,183,692 | A | 5/1965 | Check | |
| 3,210,973 | A | 10/1965 | Basseches | |
| 3,255,620 | A | 6/1966 | Quillen | |
| 3,257,831 | A | 6/1966 | Schlage | |
| 3,315,503 | A | 4/1967 | Schlage | |

(Continued)

FOREIGN PATENT DOCUMENTS

| | | |
|---|---|---|
| DE | 3627547 | 2/1988 |

(Continued)

*Primary Examiner*—Chuck Y. Mah
*Assistant Examiner*—Michael J. Kyle
(74) *Attorney, Agent, or Firm*—Michael Best & Friedrich LLP

(57) ABSTRACT

In some embodiments, lock assemblies are disclosed which have a housing, a barrel, and at least one tumbler. In some cases, the lock is codeable after the lock assembly has been assembled. Although not required, some embodiments can be re-coded to a new code with and without disassembling the lock assembly. The tumbler(s) can be pivotable, while in other embodiments the tumbler(s) move in a substantially linear fashion. The tumbler(s) can be comprised of two pieces or portions, wherein one piece/portion of the tumbler(s) either directly or indirectly engages the coded surface of a key while the other piece/portion is positionable to prevent rotation of the barrel with respect to the housing. In some embodiments, the tumblers are external to the barrel.

8 Claims, 19 Drawing Sheets

U.S. PATENT DOCUMENTS 3,563,071 A 2/1971 Barger
3,665,741 A 5/1972 Holst
3,727,440 A 4/1973 Greenwald et al.
3,983,728 A * 10/1976 Phillips ..... 70/339
3,999,413 A 12/1976 Raymond et al.
4,069,694 A 1/1978 Raymond et al.
4,072,032 A 2/1978 Phillips
4,094,175 A 6/1978 Pechner
4,372,139 A 2/1983 Laake
4,375,159 A 3/1983 Bechtiger et al.
4,376,382 A 3/1983 Raymond et al.
4,393,672 A 7/1983 Gelhard
4,516,417 A 5/1985 Parrock
4,620,429 A 11/1986 Quillen
4,712,399 A 12/1987 Mattossovich
4,712,401 A 12/1987 Monahan
4,712,402 A 12/1987 Monahan
4,729,231 A 3/1988 Wu
4,741,188 A * 5/1988 Smith ..... 70/383
4,747,281 A 5/1988 Monahan
4,836,002 A 6/1989 Monahan
4,850,210 A 7/1989 Adler et al.
4,912,953 A 4/1990 Wobig
4,942,749 A * 7/1990 Rabinow ..... 70/495
4,966,021 A 10/1990 Boag
5,103,661 A 4/1992 Fann et al.
5,421,179 A 6/1995 Bergstrom
5,438,857 A 8/1995 Kleinhaeny
5,502,990 A * 4/1996 Hirvi ..... 70/383
5,582,050 A 12/1996 Haggstrom
5,718,136 A 2/1998 Aldieri et al.
5,778,712 A 7/1998 Wallden
6,119,495 A 9/2000 Loreti
6,263,713 B1 7/2001 Fantl
6,295,850 B1 10/2001 Anderson
6,481,255 B1 * 11/2002 Theriault et al. ..... 70/495
2003/0037582 A1 2/2003 Edwards, Jr. et al.
2003/0089149 A1 5/2003 Suzuki et al.

FOREIGN PATENT DOCUMENTS

EP 0 352 495 1/1990

* cited by examiner

VEHICULAR LOCK APPARATUS AND METHOD

This application claims the benefit of prior filed co-pending provisional patent application No. 60/345,631 filed on Jan. 3, 2002.

FIELD OF INVENTION

This invention relates generally to locks and methods of operating locks, and more particularly to codeable vehicular locks and methods for coding vehicular locks.

BACKGROUND OF THE INVENTION

Despite numerous developments in vehicular lock technology, several problems still exist with conventional vehicular locks. Among the most familiar to vehicle manufacturers are problems related to pre-coded lock sets. Vehicles are typically provided with a set of locks, such as multiple door locks, a trunk lock, a glove box lock and/or an ignition lock. In most cases, two or more of the locks for a vehicle are operated with a common key. Where multiple locks for a vehicle are coded to the same key, the commonly-coded locks are often sent to a vehicle manufacturer together as a set. During vehicle assembly, these lock sets must be carefully labeled and tracked to ensure that they are installed in the same vehicle—even after being sent to different assembly stations or otherwise being moved to different locations in preparation for installation. When a vehicle is being assembled, it is important that each lock in the set be installed in the same vehicle. If locks from different sets get interchanged during assembly, multiple vehicles would have to have new locks installed. This can involve the removal of such vehicles from an assembly line and/or can cause the assembly line to be temporarily stopped. Thus, the use of pre-coded lock sets can be very costly and time consuming to vehicle manufactures.

Generally, a codeable lock is a lock that can be coded to a key after the lock has been assembled and/or after the lock has been installed. Typically, conventional codeable locks employ two-piece tumblers. These two-piece tumblers often have a first member that "reads" the coded surface of a key inserted in the lock assembly and a second member that can releasably engage a housing of the lock assembly. In such lock assemblies, the two tumbler members are normally not connected or otherwise engaged to one another prior to coding of the lock assembly. However, the code of the lock is determined at least in part upon the relationship between these two tumbler members when they are joined together. To join the member of each tumbler together in order to code the lock assembly, a key is inserted into the lock assembly. In some cases, the positions of the tumbler members change according to the depth of the key cut at the locations of the tumblers. Next, with the key still inserted, the two members of each tumbler are forced together to set the code for the tumblers. The relationship between the two pieces can be held by serrated edges on the pieces joined together. Thus, with a codeable lock, there is little to no concern regarding mixing lock sets together. Unfortunately, this type of codeable lock design has a number of inherent limitations that limit its feasibility for use in many applications (such as vehicular applications).

One problem with conventional codeable locks is that they normally do not enable enough coding sequences. Generally, a pre-coded lock has multiple tumblers that read the key surface in a number of positions along a key. For example, many pre-coded locks read the key surface at seven places along the key. At each of these positions, a key can have a number of different depths. In many locks for example, the key has five depths that are read by locks. Thus, many pre-coded locks are potentially capable of a large number of different codings (in some cases, over 70,000 combinations). Many codeable locks, however, cannot be coded to a large number of different depths of a key, or at least can only be coded to a fraction of the number of possible key depths. For example, rather than having five different depth codings per tumbler, some codeable locks are only capable of having a maximum of three depth codings per tumbler. A number of key and lock design considerations limit the number of practical codes for a key. For example, it is normally desirable to avoid key codes in which all or substantially all of the notch depths are the same. However, larger numbers of potential codes for a lock normally result in larger numbers of practical codes for the same lock.

One of the reasons why only a limited number of coding sequences is possible in conventional codeable locks is due to the serrated edges often employed in multiple-piece (e.g., two-piece) tumblers. In order for a conventional codeable lock to be strong enough to withstand attempts at picking or overpowering the lock, the serrations retaining the engagement of the tumbler members to one another must be relatively large. Since the size of a vehicle lock's barrel is already predetermined by a number of esthetic standards and other design considerations, these large serrations permit fewer coding variations between the members of each tumbler. One way a conventional codeable lock with a fixed barrel size could have more coding variations is to employ smaller serrations for the tumbler members. Unfortunately, this also makes the lock more susceptible to picking and overpowering and to inadvertent shifting between the two tumbler pieces.

Another significant limitation in conventional codeable locks is related to the linear movement of the two-piece tumblers sometimes employed. Specifically, conventional two-piece tumblers employ tumbler members that move in a linear fashion during the coding process. In other words, the key-engaging member is limited to linear displacement in response to contact with the key notch steps of the key surface. In a number of applications (including automotive applications), the maximum size of the key and the distance between the deepest and shallowest key notches are largely determined by esthetic considerations. An advantage of using two-piece pivotable tumblers in a codeable lock rather than using linearly-moving tumblers in a codeable lock is that the pivoting tumbler is capable of magnifying the key notch depths read by the tumbler. This is due to the fact that the length of an arc traced by a pivoting tumbler increases as the distance from the pivot point of the tumbler increases.

Another problem with conventional codeable locks is that such locks have normally been designed for use in building doors. The design constraints for vehicle door locks can be significantly greater than those for building door locks. For example, building door locks can often be made larger without consequence, thereby enabling such locks to have more room for more coding sequences. To scale the barrel down to the customary size of a barrel on a vehicle (where lock size and weight are typically much greater concerns) would only magnify the problems discussed above. In light of the problems and limitations of the prior art described above, a need exists for a codeable lock assembly that is reliable, can be relatively small, is strong enough to resist picking and overpowering, can be manufactured and assembled at relatively low cost, can have a large number of coded states, is simple to operate for purposes of coding the lock assembly, and can employ tumbler elements that pivot during the coding process. Each embodiment of the present invention achieves one or more of these results.

SUMMARY OF THE INVENTION

The lock assembly according to some embodiments of the present invention has a housing, a barrel disposed within the housing and rotatable with respect thereto, and at least one pivotable tumbler. In some embodiments, the lock assembly has a plurality of pivotable tumblers. The pivotable tumblers can provide many advantages that many tumblers moving in a linear manner cannot. Comparing the path of an arc to a chord of the arc (which represents a linear path), it is clear that the arc can provide more movement within a confined space. Pivotable tumblers can therefore allow for more possible coding sequences than many linear-acting tumblers because the pivoting motion allows for more movement within the confined space of a lock assembly barrel.

In some embodiments of the present invention, the tumblers are two-piece rotatable tumblers, one piece of the two-piece tumblers engaging the coded surface of a key while the other piece engages the housing. These tumblers can provide many advantages when compared to conventional linear-acting two-piece tumblers. As discussed above, one advantage is the potential for an increased number of coding sequences for the tumblers. In some embodiments, this is due at least in part to the fact that pivoting motion creates a longer path of tumbler member motion within a confined space. In addition, more relative motion can be enabled by such a relationship between tumbler pieces, which allows for more coding sequences, if desired.

Alternatively or in addition, the pieces of a two-piece tumbler can be arranged to lie substantially in two different adjacent planes, thereby conserving valuable space that can be used to accommodate larger and stronger coding surfaces of the tumbler pieces. For example, if a serrated edge were used to lock the two elements of a tumbler together during tumbler coding, the serrations could be made larger (and in some cases, larger than those of conventional locks), which provides for greater tumbler strength. The serrations can be larger because more room is created for elements to move due to the pivoting movement (as discussed above) and/or due to the two tumbler pieces being located in different adjacent planes.

In some embodiments of the present invention, the tumblers are external to the barrel. These tumblers can be pivotable with respect to the barrel. However, because more room can be available for multiple coding sequences due to the external locations of the tumblers, the tumblers in such embodiments can instead move in a linear or substantially linear fashion. Additionally, these embodiments can utilize a sidebar to prevent rotation of the barrel with respect to the housing in the locked state.

Also, some embodiments of the present invention employ two piece tumblers that move linearly or substantially linearly, and move in an overlapping relationship to gain additional space within the barrel for added security and more coding sequences. In this regard, various combinations of male/female couplings can be employed to create overlap between the two pieces when they are placed in the coded condition. For example, in some embodiments one piece of the two piece tumbler is secured about a portion of the other piece in the coding process. In other examples, a pin or other projection on one piece mates with an aperture or other feature of the other piece.

In some cases, the codeable lock embodiments of the present invention are codeable after the lock assembly has been assembled (whether using pivotable two-piece tumblers or otherwise). This capability can provide one or more of the advantages discussed above. As also previously discussed, advantages can be achieved by employing pivotable two-piece tumblers in such embodiments, including the fact that more codings can be enabled by the use of an rotational tumbler path within the confined space of the lock assembly. Other advantages provided by some embodiments include the lack of need for lock sets, elimination of problems associated with tracking the location of locks within a set, and the reduction of costly vehicle assembly mistakes.

Although not required, the lock assembly according to some embodiments of the present invention can be re-coded to a new code, and in some cases can be re-coded without disassembling the lock assembly, thereby saving considerable cost in re-coding a vehicle if a key is lost or stolen.

Further objects and advantages of the present invention, together with the organization and operation thereof, will become apparent from the following detailed description of the invention when taken in conjunction with the accompanying drawings, wherein like elements have like numerals throughout the drawings.

BRIEF DESCRIPTION OF THE DRAWINGS

The present invention is further described with reference to the accompanying drawings, which show various embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numeral indicate like parts.

DETAILED DESCRIPTION OF THE EMBODIMENTS

Figure 1:
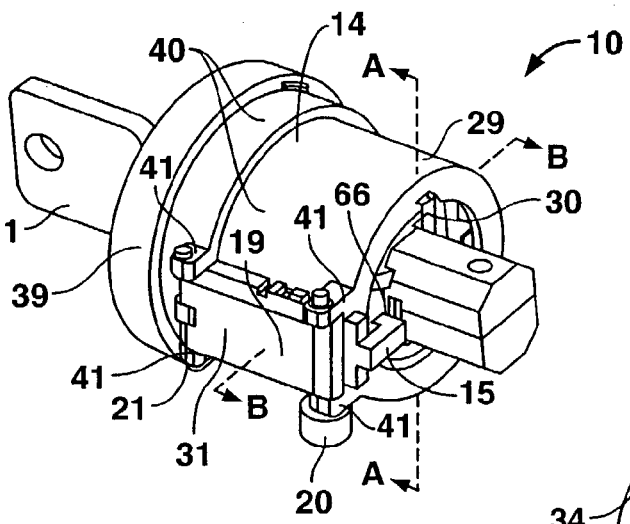
FIG. 1 is a rear perspective view of a codeable tumbler lock assembly according to a first embodiment of the present invention, shown with a key inserted therein.

One embodiment of a lock assembly according to the present invention is illustrated in FIGS. 1–13. With reference first to FIGS. 1–5, the illustrated lock assembly (indicated generally at 29) includes a housing 14, a barrel 30 located within and selectively rotatable with respect to the housing 14, and tumblers 23 coupled for pivotable movement within the barrel 30. By way of illustration, a lock and key set 10 of this nature operates by inserting a properly coded key 1 into a key slot 26 (see FIG. 12) at the end of the barrel 30. As the key 1 enters the barrel 30, the coded surface of the key 1 engages the pivotable tumblers 23, causing a part of each tumbler 23 to pivot. In other embodiments, entry of the key 1 into the barrel 30 causes each tumbler 23 to pivot in its entirety. As used herein, the term "pivotable tumbler" (in its various forms) refers to one-piece tumblers 23 that are pivotable within the lock assembly 29 as well as two-piece or multiple-piece tumblers 23 having one or more pieces that are pivotable within the lock assembly 29.

Figure 2:
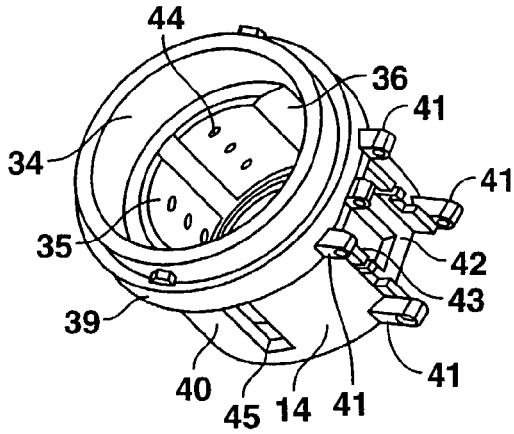
FIG. 2 is a front perspective view of the housing shown in FIG. 1.
Figure 3:
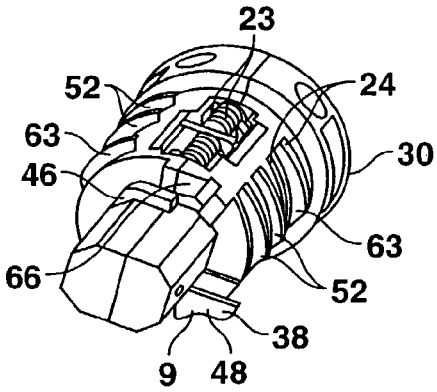
FIG. 3 is a perspective rear view of the barrel shown in FIG. 1 removed from the housing with the tumblers and the shipping tumbler extended.
Figure 4:
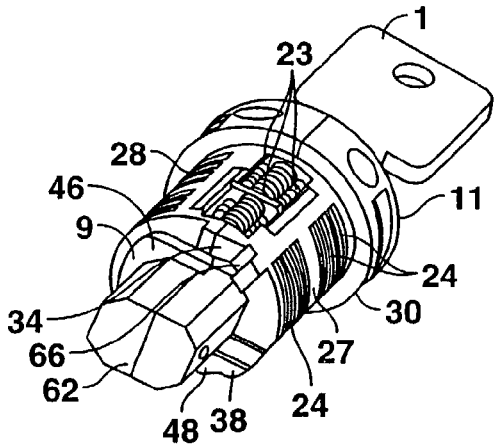
FIG. 4 is an perspective rear view of the barrel and the tumbler subassembly shown in FIG. 3 with a key inserted and the tumblers and the shipping tumbler retracted.
Figure 5:
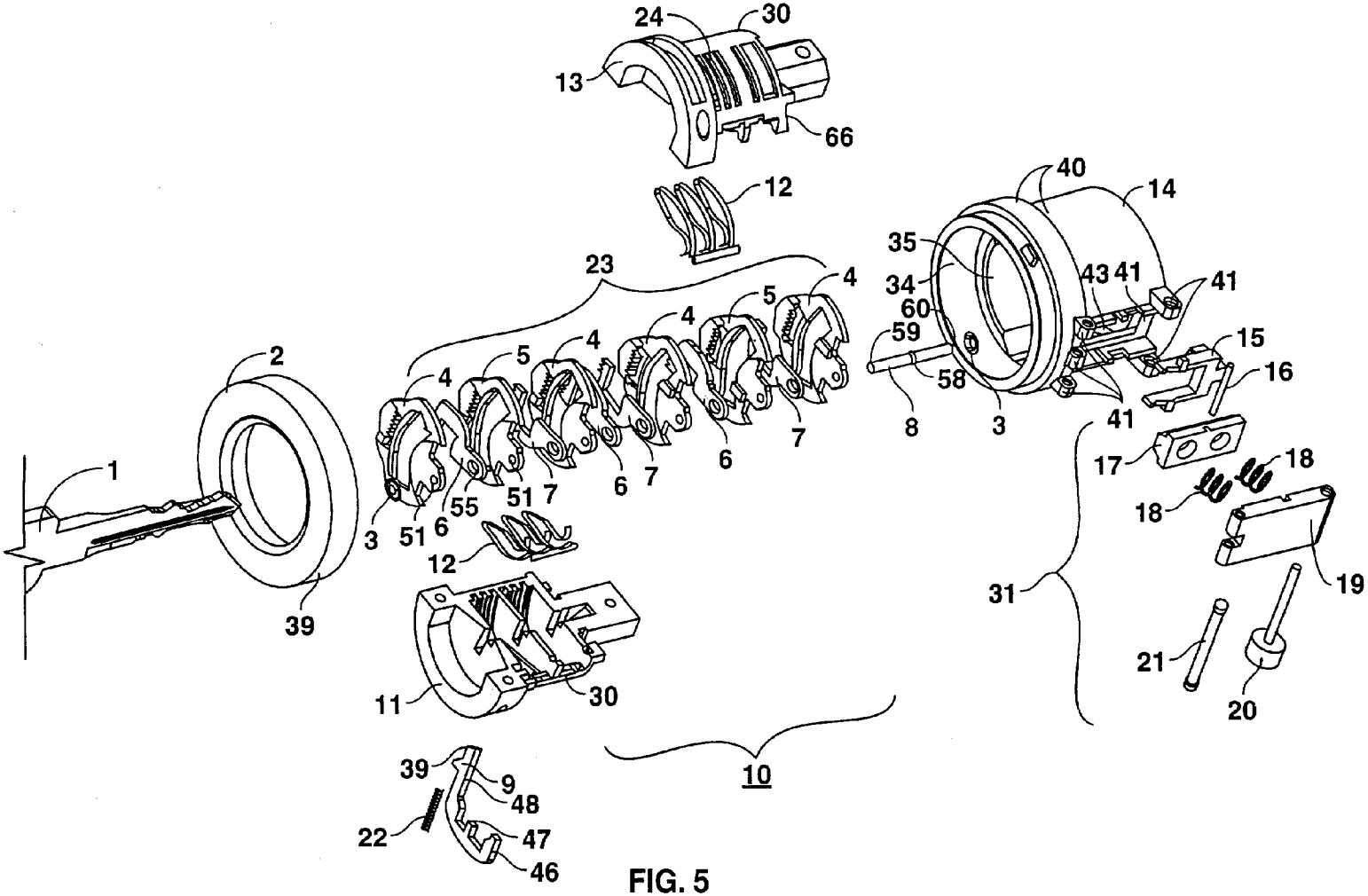
FIG. 5 is an exploded view of the codeable tumbler lock assembly and key shown in FIGS. 1–4.
Figure 6:
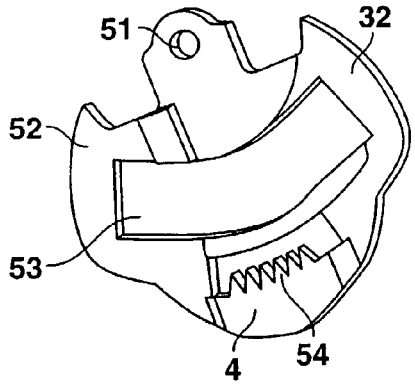
FIG. 6 is a perspective view of a first housing-engaging tumbler element shown in FIG. 5.
Figure 7:
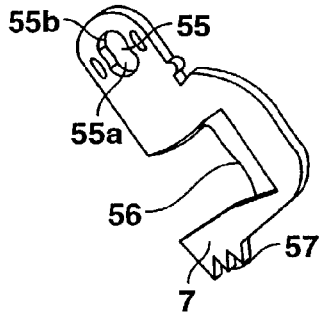
FIG. 7 is a perspective view of a first key-engaging tumbler element shown in FIG. 5.
Figure 8:
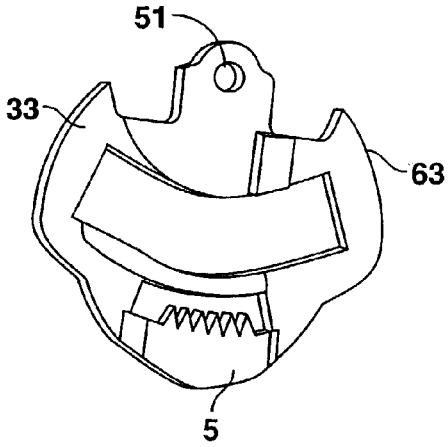
FIG. 8 is a perspective view of a second housing-engaging tumbler element shown in FIG. 5.
Figure 9:
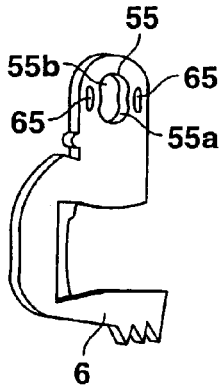
FIG. 9 is a perspective view of a second key-engaging tumbler element shown in FIG. 5.

When the properly-coded key 1 is fully inserted into the lock assembly 29, the tumblers 23 are moved by surfaces of the key 1 from respective positions in which one or more tumblers 23 extend out of the barrel 30 (FIG. 3) to positions in which the tumblers 23 are retracted within the barrel 30 (FIG. 4). In some embodiments, all of the tumblers 23 are moved from extended positions to retracted positions upon insertion of the key 1. The key 1 and the barrel 30 can then be rotated to unlock the mechanism to which the lock assembly 29 is connected. In this position, the lock assembly 29 is unlocked. The key 1 can then be rotated back to the original position and can be removed (or in some embodiments, can be removed without such rotation). In this position, the lock assembly 29 is in a locked state because the barrel 30 cannot rotate within the housing 14. By removing the key 1, the tumblers 23 can pivot back to their original positions in which at least one tumbler 23 extends from the barrel 30 toward the housing 14. With reference to FIGS. 1, 2, and 5 of the illustrated embodiment, the lock assembly 29 of this embodiment has a housing 14. In some embodiments, the housing 14 is the interface between the lock assembly 29 and the element, assembly, or device being locked. The outer surfaces 39 and 40 of the housing 14 can be configured for mating to and retaining the lock assembly 29 in elements, assemblies, and devices of various applications, including but not limited to vehicle doors, deck lids, steering columns, dashboards, trunks, glove boxes, and other vehicular applications.

In some embodiments of the present invention, the housing 14 also supports various other working components of the lock assembly 29. As shown in FIG. 2 for example, the housing 14 can have a varying diameter along its length into which the barrel 30 is axially received. The inner surface of the barrel 30 can have stepped surfaces (34, 35) as shown, can vary in any other manner, or can have a substantially constant diameter. The housing 14 of some embodiments has two internal axial grooves 36, 37 that can receive portions 52, 63 of the pivotable tumblers 23 (see FIGS. 2 and 11A–E) extending from the barrel 30 in the locked state of the lock assembly 29. The two internal axial grooves 36, 37 can also receive portions 32, 33 of the pivotable tumblers 23 which can extend from the barrel 30 when the wrong key is inserted into the barrel 30. As mentioned above, when the tumblers 23 are moved to extend from the barrel 30 to the housing 14, the tumblers 23 resist rotation of the barrel 30 within the housing 14. Any number of grooves 36, 37 or other recesses can be located in any portion of the barrel interior in order to receive the tumblers 23 for this purpose. Because the tumblers 23 in the embodiment illustrated in FIGS. 1–13 are pivotable in two different directions about an axis as will be described in greater detail below, a minimum of two grooves in the housing 14 are employed with this embodiment. In some embodiments, the barrel 30 accepts and supports the pivotable tumblers 23 as well as one or more resilient biasing members (such as springs 12) to bias some or all of the pivotable tumblers 23 in a direction extended from the barrel 30 toward the housing 14. In this regard, the barrel 30 can have apertures 24 through which the tumbler ends 52, 63 extend when they are pivoted to extended positions (i.e., locked positions) as shown in FIG. 3, and through which the tumbler ends 52, 63 can extend when a wrong key is used. Alternatively, the barrel 30 can have any other shape permitting the tumbler ends 52, 63 to extend toward the housing 14 for engagement therein or to be received within recesses, grooves, or other apertures in the housing 14. In the unlocked position shown in FIG. 4, the tumbler ends 52 & 63 retract back within the periphery of the barrel 30 to permit the barrel 30 to rotate within the housing 14.

As shown in FIGS. 1 and 3–5, the barrel 30 can be constructed in two sections 11, 13 joined together by rivets, welds, screws, bolts, snap-fit connections, adhesive or cohesive bonding material, bands, clips, pin and aperture connections, or in any other manner. The barrel 30 can instead be one element manufactured in any conventional manner (e.g., molded, machined, cast, and the like), or can be made of three or more sections connected together in any of the manners described above with reference to the two illustrated barrel sections 11, 13.

In some embodiments, the barrel 30 has a shutter mechanism (not shown) at least partially covering or shielding the key slot 26. The shutter can be mounted upon the end of the barrel 30 adjacent to the key slot 26. Also, an output mechanism can be connected to an opposite end of the barrel 30 for transmitting force from the barrel 30 to one or more elements connected to the lock assembly 29. The output mechanism can take a number of different forms, including without limitation a lever, drive shaft, coupling, cam, or other element mounted to the lock assembly 29.

As previously mentioned, the pivotable tumblers 23 can be coupled to the barrel 30 for rotation with respect to the barrel 30. The tumblers 23 can be pivotably mounted in any manner. However, in the illustrated embodiment shown in FIG. 3, the tumblers 23 are pivotably mounted upon a pivot 8 coupled to the barrel 30.

As shown in the embodiment illustrated in FIG. 11, the tumblers 23 can engage the key 1 when the key 1 is inserted into the barrel 30, and can engage the housing 14 when the key 1 is not inserted into the barrel 30. The tumblers 23 can be made of any material sufficiently durable and strong to withstand attempts at picking the lock and unauthorized forced rotation of the barrel, and to resist wear from interfacing with the key 1. The tumblers 23 can be sized to engage a key at various depths of the key's edge(s). Thus, by using a plurality of tumblers 23 that engage the key 1 with differing key depths, the lock 29 will only unlock with a properly coded key 1. In some embodiments such as the embodiment illustrated in FIGS. 1–13, tumblers are located on opposite sides of the key 1 so that both coded edges 49, 50 of the key 1 are engaged by tumblers 23. The tumblers 23 in such embodiments can be arranged in any manner, and in some cases can be arranged in the lock assembly 29 in an alternating pattern. Also in such embodiments, the tumblers 23 can be positioned to pivot in substantially opposite directions responsive to insertion or removal of the key 1.

Although each tumbler 23 of the present invention can be a single element, the tumblers in some embodiments are each defined by two or more elements. For example, the tumblers 23 can be two-piece tumblers as shown in FIGS. 5–9 and 11A–E. As illustrated, each pivotable two piece tumbler combination 23 is comprised of a housing-engaging element 4 or 5 and a key-engaging element 6 or 7. In some embodiments, the housing-engaging elements 4, 5 are movable to engage the housing 14 in a locked mode of the lock assembly 29 (in order to prevent rotation of the barrel 30) and to disengage from the housing 14 in an unlocked mode (in order to permit rotation of the barrel 30 with respect to the housing 14). Also, the key-engaging elements 6 and 7 can engage the coded surfaces 49 and 50 of the key 1. In other embodiments, the key-engaging elements 6 and 7 can be positioned to engage only one of the coded surfaces 49, 50 on one side of the key 1 as described above. In either case, the key-engaging elements 6, 7 each can have one or more surfaces 56 which are contacted by the coded surface(s) of the key 1 when the key 1 is inserted into the lock assembly 29. This contact causes the key-engaging elements 6, 7 to move with respect to the housing-engaging elements 4, 5 for purposes of coding the two-piece tumbler combination 23 as will be described in greater detail below.

In some embodiments, the housing-engaging elements 4 and 5 are pivotably independent of the key-engaging elements 6 and 7 when the lock assembly 29 is in an uncoded state. When the lock assembly 29 is in a coded state, such housing-engaging elements 4 and 5 are no longer pivotably independent of the key-engaging elements 6 and 7.

The tumblers 23 (and in the case of multiple-part tumblers, an element of the tumblers 23) can be pivotable within the barrel 30 in a number of different manners. In one embodiment for example, the housing-engaging elements 4, 5 are pivotable about a pivot 8. The housing-engaging elements 4, 5 can be pivotable about the pivot 8 in any manner, such as by receiving the pivot 8 within apertures 51 in the housing-engaging elements 4, 5 as illustrated in FIGS. 5 and 11A–E. If desired, the pivot 8 can have a larger diameter section 58 at a location between the ends 59, 60 of the pivot 8 to provide a location for additional support of the pivot 8 and tumblers 23.

Although the housing-engaging element 4, 5 can take any shape capable of moving into and out of engagement with the housing 14 as described above, the housing-engaging elements 4, 5 in some embodiments have an aperture therein through which the key 1 can be received. The elements 4 and 5 of this embodiment also have at least one portion 52, 63 (or two portions 52, 63 in other embodiments) that engages the housing 14 in the locked state of the lock assembly 29 as described above.

In those embodiments of the present invention employing multiple-piece tumblers 23, the pieces of the tumblers 23 can be movable with respect to one another and can engage one another in different relative positions. This engagement can be produced in a number of different manners. In the illustrated embodiment for example, each housing-engaging element 4, 5 can engage a corresponding key-engaging element 6, 7 by inter-engaging teeth on both elements 4, 5 and 6, 7. In this manner of engagement, at least one projection or recess 54 on the housing-engaging element 4, 5 can be engaged with at least one recess or projection 57, respectively, on the key-engaging element 6, 7. In other embodiments, however, either the housing-engaging element 4, 5 or the key-engaging element 6, 7 have multiple recesses or projections to enable the elements 4, 5, and 6, 7 to engage one another in at least two different relative positions. Yet in other embodiments, both elements 4, 5 and 6, 7 have multiple recesses or projections to provide for multiple relative engaged positions of the elements 4, 5, 6, 7.

Although inter-engaging projections and recesses 54, 57 can be employed to engage the housing-engaging elements 4, 5 and the key-engaging elements 6, 7, it should be noted that other types of elements can instead be employed for this purpose. By way of example only, the housing-engaging elements 4, 5 can have one or more magnets thereon that attract one or more magnets on the key-engaging elements 6, 7 to retain the housing-engaging elements 4, 5 in position with respect to the key-engaging elements 4, 5, 6, 7. As another example, the housing-engaging elements 4, 5 can have one or more surfaces that are pressed against by one or more surfaces of the key-engaging elements 6, 7 with sufficient force to retain the housing-engaging elements 4, 5 in a desired positional relationship with the key-engaging elements 6, 7. Still other elements and features of the housing and key-engaging elements 4, 5, 6, 7 can be employed to retain the housing-engaging elements 4, 5 in a desired positional relationship with respect to the key-engaging elements 6, 7. In still other embodiments, both elements 4, 5 and 6, 7 can be held together by a snap fit, a friction fit, and the like.

In some embodiments of the present invention (such as the embodiment illustrated in FIGS. 1–13), the housing and key-engaging elements 4, 5, 6, 7 are generally flat in shape. In other embodiments, the housing and key-engaging elements 4, 5, 6, 7 have any other shape desired. However, generally flat element shapes can be utilized for purposes of space conservation.

The projections and recesses 54, 57 of the housing and key-engaging elements 4, 5, 6, 7 can be located on any portion of the housing and key-engaging elements 4, 5, 6, 7 which permits these elements to engage with one another as will be described in greater detail below. However, the inventors have discovered that space within the lock assembly 29 is better utilized and performance of the lock assembly 29 is improved when part of the housing-engaging element 4, 5 and/or part of the key-engaging element 6, 7 is located in a plane that is different than the remainder of the housing-engaging element 4, 5 and key-engaging element 6, 7, respectively. More specifically, it is desirable in some embodiments for the engaging elements or features (e.g., projections or recesses 54, 57) of the housing and/or key-engaging elements 4, 5, 6, 7 to be located out of plane with respect to the rest of the same elements 4, 5, 6, 7. For example, as illustrated in the embodiment shown in FIGS. 5–9 and 11, the projections and recesses 54 of each housing-engaging element 4, 5 are located on a portion of the housing-engaging element 4, 5 that is out of plane with respect to the rest of the housing-engaging element 4, 5. If desired, the key-engaging elements 6, 7 can also or instead have offset recesses and projections 57. In some embodiments, either the housing-engaging elements 4, 5 or the key-engaging elements 6, 7 (not both) have such offset engaging features or structure.

In those embodiments of the present invention employing tumblers having two or more elements (as described above), the tumbler elements moved into an engaged relationship with each other can remain in such a relationship during and after repeated use of the lock assembly. This can be accomplished in a number of different ways, depending at least in part upon the manner in which the tumbler elements are engaged. For example, if magnet sets retain the tumbler elements in an engaged relationship with one another, then the magnet sets may be sufficient to retain this relationship. Similarly, if a friction fit or snap fit is used to retain the engaged relationship with one another, then the friction fit or snap fit may be sufficient to retain this relationship. In other embodiments, the engaged relationship between tumbler elements is maintained by changing the point about which one (or more) of the tumbler elements pivots. The key-engaging elements 6, 7 in the embodiment illustrated in FIGS. 1–13 provide an example of such element control.

Specifically, as shown in the illustrated embodiment in FIGS. 5, 7, 9, and 11, the pivot 8 can pass through an aperture 55 in the key-engaging elements 6, 7 shaped to receive the pivot 8 in two different positions. The key-engaging elements 6, 7 can pivot about the pivot 8, and can be shifted with respect to the pivot 8 from one position to another. As illustrated, the aperture 55 is shaped to retain the pivot 8 in at least one of the two different positions so that the key-engaging elements 6, 7 can be shifted with respect to the pivot 8 and can be retained in a position in which the key-engaging elements 6, 7 are engaged with the housing-engaging elements 4, 5. In the embodiment illustrated in FIGS. 1–13 for example, the key-engaging elements 4, 5 have two-position apertures 55 that are hour-glass shaped. The hour-glass shape of these apertures 55 permits the pivot 8 to be moved within the apertures 55 (or the apertures 55 to be moved with respect to the pivot 8) and to "snap" into place a position with respect to the pivot 8 in which the key-engaging elements 6, 7 are engaged with the housing-engaging elements 4, 5 as described above. In this regard, the apertures 55 can be deformable to produce a snap action between the two positions 55*a*, 55*b* of the key-engaging elements 6, 7 on the support 8. In some embodiments, hole deformability can be achieved by one or more slots, cuts, holes, or relief apertures 65 near the pivot apertures 55, by providing relatively thin or otherwise flexible walls of the pivot apertures 55, by employing one or more protrusions between the pivot aperture positions, and the like.

In some embodiments, the key-engaging elements 6 and 7 are placed on the pivot 8 in an uncoded position during assembly of the lock 29. For example, in the illustrated embodiment, the pivot 8 passes through the inboard position 55*a* of the two position aperture 55, thereby positioning the projection(s)/recess(es) 57 of the key-engaging elements 6, 7 so that they are disengaged from the mating projection(s)/recess(es) of the housing-engaging elements 4, 5. The tumbler combinations 23 can be retained on the pivot 8 by press on washers 3, threaded on nuts, welds, clips, collars, or other like elements at either or both ends 59 and 60 of the pivot 8. However, in some alternative embodiments (such as those in which tumbler coding by element movement with respect to the pivot 8 is not required), the pivot 8 can be formed as part of one element of the two piece tumbler 23.

Although the tumblers 23, pivot 8, and other elements of the lock assembly 29 can be assembled in any manner, in some embodiments the uncoded tumbler element combinations (i.e., a housing-engaging element 4 matched up with a key-engaging element 7 or a housing-engaging element 5 matched up with a key-engaging element 6) can be assembled on the pivot 8 and inserted within the barrel 30 as a unit subassembly.

The coding process of the present invention will now be described with reference to the embodiment illustrated in FIGS. 11A–11E by way of example only. In this illustrated embodiment, the coding process of the lock assembly 29 begins with the insertion of the key 1 as shown in FIG. 11B. As the key 1 enters the barrel 30, the key-engaging elements 6 and 7 pivot to an extent determined at least in part by the depth of the coding on the key surface 49, 50. Once the key 1 is fully inserted, the key-engaging elements 6 and 7 rest against the coded surfaces of the key 49, 50.

Figure 11C:
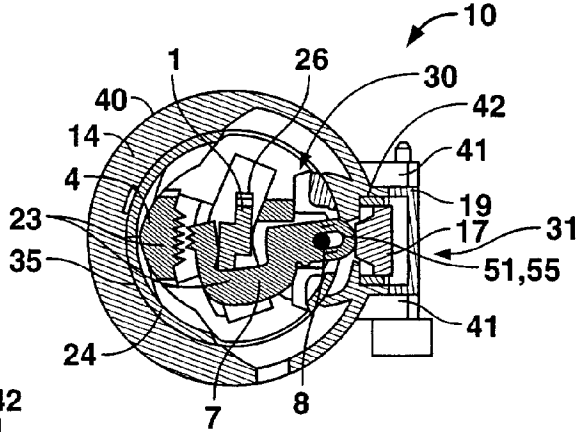
FIG. 11C is the cross-sectional view of the assembly illustrated in FIG. 11A, shown with a key turned in the assembly prior to activation of the tumbler shifting assembly.
Figure 11A:
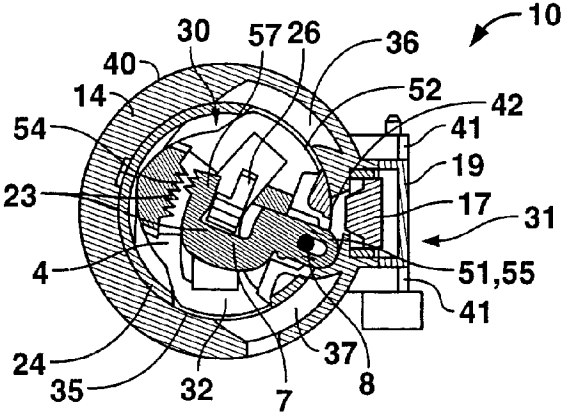
FIG. 11A is a cross-sectional view of the codeable tumbler lock assembly illustrated in FIGS. 1 and 5, taken along section B—B of FIG. 1 and shown in a shipping orientation prior to insertion of a key (FIG. 11A)
Figure 11B:
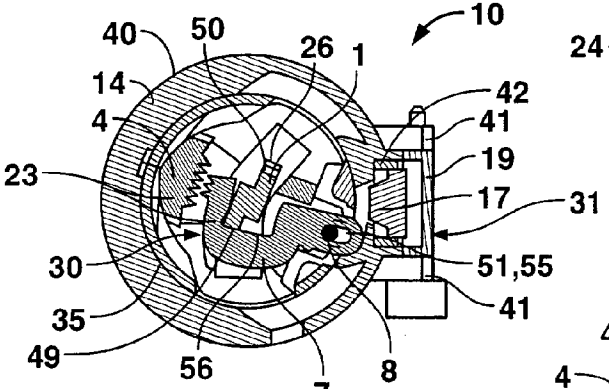
FIG. 11B is the cross-sectional view of the assembly illustrated in FIG. 11A, shown with the codeable tumbler locking a shipping orientation with a key inserted in the assembly.
Figure 11D:
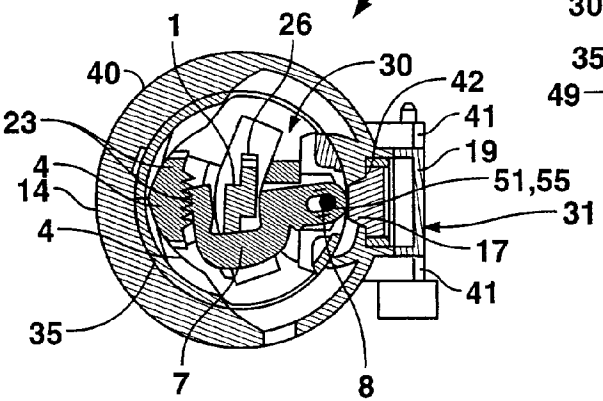
FIG. 11D is the cross-sectional view of the assembly illustrated in FIG. 11A, shown with a key turned in the assembly and the tumbler shifting assembly activated.

As shown in the sequence illustrated in FIGS. 11B–11D, the lock 29 is coded to the key 1 by rotating the barrel 30 with respect to the housing 14 in response to turning the key 1. As the barrel 30 is turned, the key-engaging elements 6 and 7 are shifted upon the pivot 8 from the inboard pivot hole position 55*a* to the outboard pivot hole position 55*b* (see FIGS. 11C and 11D in combination with FIGS. 7 and 9). This shift can be caused in a number of different manners, such as by a camming action of the key-engaging elements 6, 7 against an interior surface of the housing 14, by one or more springs directly or indirectly exerting force against the key-engaging elements 6, 7 in at least one rotational position of the barrel 30, and the like.

Figure 11E:
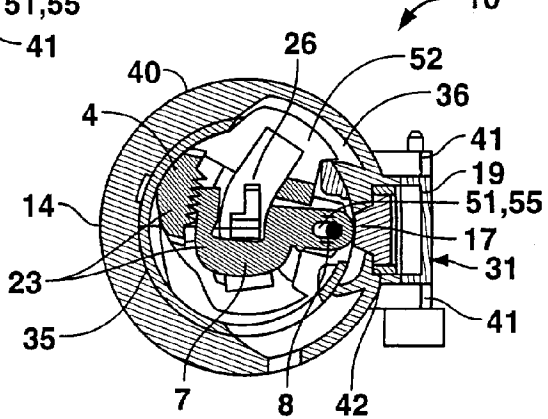
FIG. 11E is the cross-sectional view of the assembly illustrated in FIG. 11A, shown in a coded state.

The shift of the key-engaging elements 6 and 7 on the pivot 8 from the inboard position 55*a* to the outboard position 55*b* can cause the projection(s) and/or recess(es) 57 on the key-engaging elements 6 and 7 to engage the corresponding recess(es) and/or projection(s) 54 on the housing-engaging elements 4 and 5. This engagement produces a tumbler combination 23 coded to the particular notch depth of the key 1. Thus, in the coded state, the housing-engaging elements 4, 5 and the key-engaging elements 6, 7 can pivot together about the pivot 8. As illustrated in FIG. 11E, once the key 1 is removed, at least one spring 12 (see FIG. 5) can bias one or more of the tumblers 23 into engagement with the housing 14 and to thereby prevent rotation of the barrel 30 with respect to the housing 14.

Once the tumblers 23 have been coded, the tumblers 23 can be maintained in their coded state in one or more manners. In the two-piece tumbler embodiment illustrated in FIGS. 1–13 for example, the key-engaging elements 6, 7 are maintained in their engaged coded relationship with the housing-engaging elements 4, 5 in part by the relationship between the pivot 8 and two-position aperture 55 described above.

Another manner of maintaining the tumblers 23 in their coded state after coding is illustrated in FIGS. 1, 5, and 10–11. Specifically, the lock assembly 29 in the illustrated embodiment has a tumbler shifting mechanism 31 for shifting the key-engaging tumbler elements 6 and 7 from the uncoded positions to the coded positions within the barrel 30. The tumbler shifting mechanism 31 is connected to or is integral with the housing 14 and is adaptable to include a moveable support 15, a tumbler shifting plate/bar 17, a tumbler shifting plate support 16, one or more springs 18, and a cover 19. The cover 19 can be integrally formed with the housing 14, and in other embodiments is connected thereto with one or more pins 20, 21 (see FIGS. 1, 5 and 10), screws, rivets, clips, and other conventional fasteners, by adhesive or cohesive bonding material, by being snap fit to the housing 14, and the like. If desired, the housing 14 can be provided with one or more elements or features to enable connection of the tumbler shifting mechanism 31 thereto and to facilitate movement of the tumbler shifting mechanism 31 in order to bias the tumblers 23 as will be described below. In the illustrated embodiment for example, the housing 14 has lugs 41 for mounting the tumbler shifting mechanism 31 (although any fastener apertures, bosses, clip receptacles, or other elements can instead be employed), a channel 42 to support and guide the moveable support 15, and an aperture 43 through which the tumbler shifting plate/bar 17 can extend or otherwise be received to bias the tumblers 23 inside the housing 14.

Figure 10A:
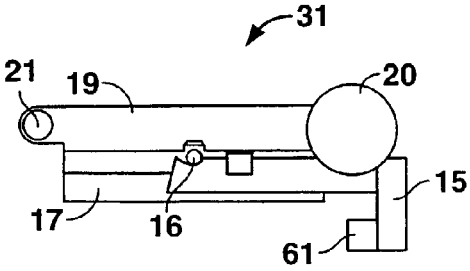
FIG. 10A is a side view of the tumbler shifting assembly illustrated in FIGS. 1 and 5, shown prior to activation.
Figure 10B:
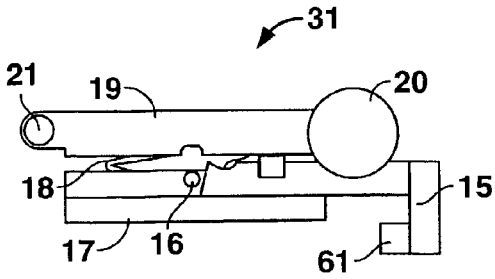
FIG. 10B is a side view of the tumbler shifting assembly illustrated in FIGS. 1 and 5, shown after activation.

The tumbler shifting mechanism 31 can be activated (the tumbler shifting plate/bar 17 is biased to exert a force upon the tumblers 23 within the housing 14 and to shift the tumblers 23 as described above) by turning the barrel 30 with respect to the housing 14. In the illustrated embodiment for example, a surface 61 on the movable support 15 (see FIGS. 1 and 10) is cammed against by part of the barrel 30 when the barrel 30 is rotated during the coding process. More specifically, as the barrel 30 is rotated during the coding process, a cam surface 66 on the back of the barrel 30 (see FIGS. 3 and 4) cams against the moveable support 15 of the tumbler shifting mechanism 31. Referring again to FIGS. 1 and 10, the surface 61 of the movable support 15 thereby functions as a cam follower. As shown in FIGS. 10A and 10B, the moveable support 15 moves with respect to the rest of the tumbler shifting mechanism 31 due to the follower 61 riding the cammed surface 66, thereby causing the tumbler shifting plate support 16 to release from the moveable support 15 and to permit the resiliently biased tumbler shifting plate/bar 17 to travel radially inward toward the barrel 30. As illustrated in FIGS. 11C and 11D, this movement of the tumbler shifting plate/bar 17 brings the tumbler shifting plate into contact with the key-engaging tumbler elements 6, 7, and causes the key-engaging tumbler elements 6, 7 to move from an uncoded state to a coded state as described in greater detail above.

Although the tumbler shifting mechanism 31 described above is one way of shifting the tumblers 23 to code the lock assembly 29, it will be appreciated that the tumbler shifting mechanism 31 can take a number of other forms capable of performing this same function. By way of example only, a tumbler shifting mechanism such as that described above can be triggered to bias the tumbler shifting plate/bar 17 toward the tumblers 23 upon insertion of the key 1 into the barrel 30. Specifically, the key 1 can directly or indirectly contact and move the movable support 15 (or like element or structure) upon insertion of the key 1 into the barrel 30. Thereafter, rotation of the barrel 30 with respect to the housing 14 can align the biased tumbler shifting plate/bar 17 with the housing aperture 43, permitting the tumbler shifting plate 43 to enter the tumbler aperture 43 and to bias the tumblers 23 as described above.

As another example, the tumbler shifting plate/bar 17 can be activated by user removal of the tumbler shifting plate support 16 retaining the tumbler shifting plate/bar 17 in a retracted position with respect to the tumblers 23 (in which case the movable support 15 or comparable element or structure would not be needed). In this regard, the tumbler shifting plate support 16 can take a number of different forms capable of being removed or otherwise released to activate the tumbler shifting plate/bar 17. Still other mechanisms can be employed to bias a tumbler shifting plate/bar 17 or other element against the tumblers 23 within the housing 14 upon insertion of the key 1 into the barrel 30 or upon rotation of the barrel 30 with respect to the housing 14. Each one of these alternative mechanisms falls within the spirit and scope of the present invention.

In some embodiments of the present invention, it is desirable to maintain the rotational position of the barrel 30 with respect to the housing 14 prior to coding the lock assembly 29 with a key 1. For example, an element or device can be employed to prevent the barrel 30 from rotating with respect to the housing 14 during shipping or handling of the lock assembly. An example of such an element is illustrated in FIGS. 1, 3–5, 12, and 13. In the illustrated embodiment, a shipping tumbler 9 maintains the position of the barrel 30 with respect to the housing 14 and thus, the orientation of the tumbler combinations before the lock assembly 29 is coded. In some embodiments, this shipping tumbler 9 or a similar mechanism (as described in greater detail in other embodiments) also prevents the coding process from beginning prematurely. For example, in the illustrated embodiment, the shipping tumbler is positioned and oriented to prevent barrel 30 rotation and coding of the lock until the key 1 is fully inserted.

Figure 12A:
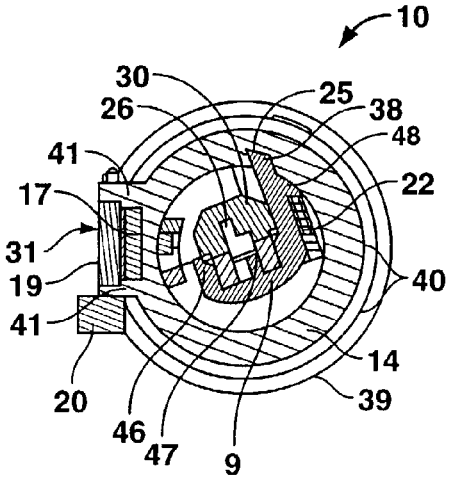
FIG. 12A is a partial section view of the codeable tumbler lock assembly illustrated in FIGS. 1 and 3–5, taken along section A—A in FIG. 1 and showing the shipping tumbler in an extended position.
Figure 13A:
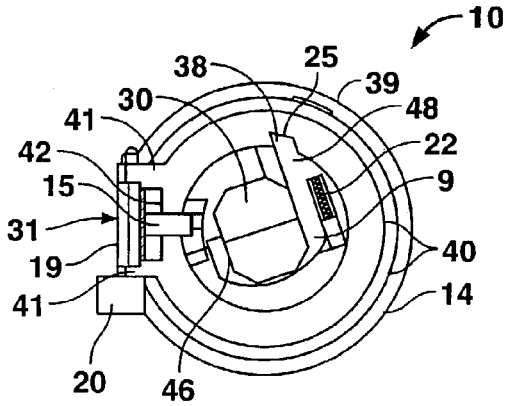
FIG. 13A is a rear end view of the codeable tumbler lock assembly illustrated in FIGS. 1 and 3–5, shown with the shipping tumbler extended.

With reference to FIG. 5, the shipping tumbler 9 can be formed in an "E" shape with three legs 46, 47, and 48. As best shown in FIGS. 12 and 13, the uncoded lock assembly 29 can be assembled and shipped with the barrel 30 rotated an amount (e.g., 21° in the illustrated embodiment, although smaller or larger rotational amounts are possible) from the neutral position (key slot vertical) and fixed in this position by the shipping tumbler 9. Referring to FIG. 12A, the barrel 30 is in the uncoded position and retained in this position by an end 38 of one of the shipping tumbler legs 38 extending into an recess, groove, slot, or other aperture 25 in the housing 14. Although the shipping tumbler 9 can be retained in this position by a snap or press-fit connection to the barrel 30, by a light frictional engagement in the aperture 25, or in another manner, the shipping tumbler 9 can also be biased into this position with at least one spring 22.

Figure 12B:
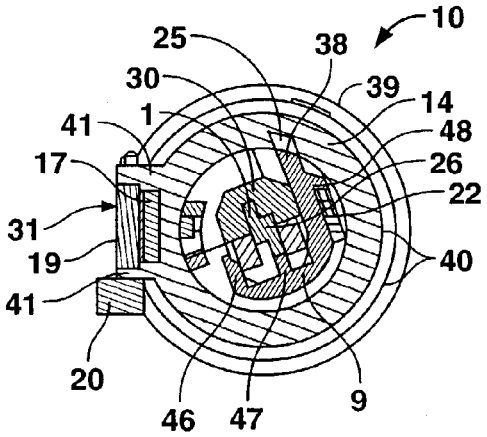
FIG. 12B is the cross-sectional view of the assembly illustrated in FIG. 12A, shown with the key retracting the shipping tumbler.
Figure 13B:
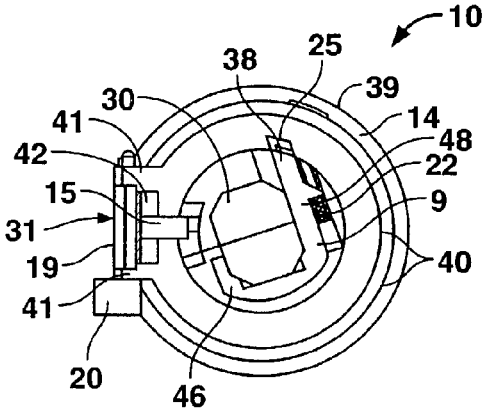
FIG. 13B is the rear end view of the codeable tumbler lock assembly illustrated in FIG. 13A, shown with the shipping tumbler retracted (FIG. 13B)
Figure 13C:
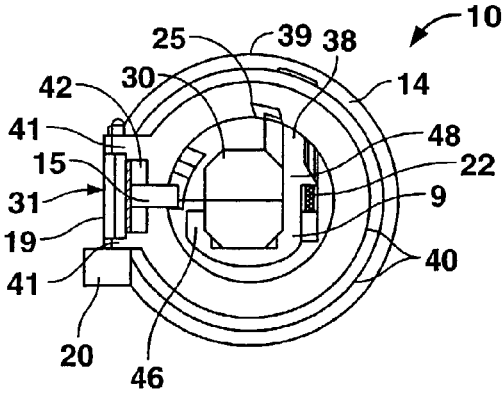
FIG. 13C is the rear end view of the codeable tumbler lock assembly illustrated in FIG. 13A, shown with the shipping tumbler retracted and the barrel rotated.

With continued reference to the illustrated embodiment shown in FIGS. 12B and 13B, insertion of the key 1 can generate movement of the shipping tumbler 9 to retract the shipping tumbler 9 from the aperture 25 in the housing 14. More specifically, when the selected key 1 is fully inserted into the barrel 30 during the coding process, a surface of the key 1 (e.g., at the tip of the key 1) can contact a leg 46 of the shipping tumbler 9, thereby camming the shipping tumbler 9 away from the housing aperture 25 against the biasing force of the shipping tumbler spring 22. Thereafter, the barrel 30 is permitted to rotate.

It will be appreciated by one skilled in the art that the shipping tumbler 9 can take a number of different shapes capable of functioning to retract upon insertion of a key 1 during the coding process. The shipping tumbler shape 9 depends at least partially upon the shape of the barrel 30, the shape of the housing 14 and the housing aperture 25, and/or the position of the shipping tumbler 9 on the barrel 30. Other shipping tumblers can be C or L-shaped, shaped similarly to the tumblers 23 in the illustrated embodiment, shaped in any conventional manner, and the like. In addition, it should be noted that the shipping tumbler 23 can be retracted from the housing aperture 25 manually by a user, if desired, and in some embodiments can even be removed from the lock assembly 29.

For purposes of illustration, FIGS. 11A–11E show a coding operation performed upon the lock assembly 29 in the illustrated embodiment of the present invention. The assembled and uncoded lock 29 can be installed on or in a member to be locked (not shown) with the shipping tumbler extended in its shipping position, the tumbler elements 4, 5, 6, 7 in their uncoded positions, and with no key in the key slot 26 of the barrel 30 as shown in FIG. 11A. Since the tumbler ends 32 and 52 contact the interior surfaces of the housing 14 and cannot enter the axial grooves of the housing due to the shipping orientation of the barrel 30, the housing-engaging tumbler elements 4, 5 are captured within the periphery of the barrel 30 in the shipping position. As a key 1 is inserted in the barrel 30, the key-engaging tumbler elements 6, 7 pivot about the pivot 8 due to the coded surface 49 of the key 1 contacting the tumbler surfaces 56 (see FIG. 11B).

With continued reference to the illustrated embodiment, once the key 1 is fully inserted within the barrel 30, the shipping tumbler 9 can be disengaged from the housing 14 (as shown in FIGS. 12 and 13), permitting the barrel 30 to rotate with respect to the housing 14. Next, the key is turned to rotate the barrel 30 to the neutral position as shown in FIG. 11C, which causes the tumbler shifting mechanism 31 to activate (i.e., to release the tumbler shifting plate/bar 17). The tumbler shifting plate/bar 17 is thereby biased towards the center of the barrel 30, which causes the key-engaging elements 6, 7 to be shifted to engage the corresponding housing-engaging elements 4, 5. Thus, the coding process is complete as shown in FIG. 11D, and the key 1 can be removed from the barrel 30. When the key 1 is removed from the barrel 30, the tumblers 23 can be biased about the pivot 8 to cause the housing-engaging tumbler element portions 32, 33, 52, 63 to extend beyond the barrel 30 periphery into the axial grooves 36 of the housing 14, thereby preventing rotation of the barrel 30 relative to the housing 14 (see FIG. 11E). In the resulting locked state of the lock assembly 29, the housing-engaging tumbler element portions 32, 33, 52, 63 extend beyond opposite sides of the barrel 30 periphery in a substantially alternating pattern to prevent barrel rotation within the housing as shown in FIG. 3.

In some embodiments of the present invention having tumblers with two or more tumbler elements, the codeable lock assembly 29 is capable of being re-coded. Re-coding can be performed in a number of different manners, each one permitting the elements of one or more tumblers 23 to be disengaged for re-coding. In the illustrated embodiment of FIGS. 1–13 for example, the housing 14 can have one or more apertures 44 permitting entry of a tool for pushing the key-engaging elements 6, 7 away from the housing-engaging elements 4, 5. Referring more particularly to FIG. 2, to recode a coded lock assembly 29 to a different key code, a key 1 already coded for the lock assembly 29 is inserted into the barrel 30 and the barrel 30 is rotated to the original shipping position. Then, a tool is inserted into each of the recoding holes 44 in the housing 14 to shift the key-engaging tumbler elements 6, 7 back to the original uncoded position in which they are retracted from the housing-engaging tumbler elements 4, 5. After this has been completed, the key 1 can be withdrawn and the tumbler shifting mechanism 31 (if used) can be reset. In the illustrated embodiment of FIGS. 1–13 for example, the tumbler shifting plate/bar 17 is retracted from its extended state (removing the pins 20, 21, cover 19, and springs 18, if necessary) and the movable support 15 is returned to its shipping position. Another key with a new code can then be inserted into the barrel 30 to repeat the coding process.

In other embodiments, the tumbler shifting mechanism 31 can be partially or fully removed or opened to permit access to the key-engaging tumbler elements 6, 7 (and/or housing-engaging elements 4, 5) for user manipulation of the key-engaging tumbler elements 6, 7. In still other embodiments, the pivot 8 can be user accessible and can be moved to move the tumblers for re-coding. By way of example only, the pivot 8 in the embodiment illustrated in FIGS. 1–13 can be moved to disengage the key-engaging elements 6, 7 from the housing-engaging elements 4, 5. In this case, a new key can then be inserted and the pivot 8 can be returned to its original position for the remainder of the coding process. Still other manners of re-coding keys in the lock assembly 29 of the present invention are possible, each one of which falls within the spirit and scope of the present invention.

Another embodiment of a pivotable tumbler lock assembly is illustrated in FIGS. 14A–14E, and is indicated generally at 129. Like the tumbler lock assembly 29 in the embodiment illustrated in FIGS. 1–13, the embodiment illustrated in FIGS. 14A–14E employs pivotable tumblers 123 within a barrel 130 that is selectively rotatable with respect to a housing 114. Also like the embodiment illustrated in FIGS. 1–13, this embodiment utilizes codeable pivotable tumblers 23 each defined by multiple elements that are movable with respect to one another. The illustrated embodiment of FIGS. 14A–14E employs tumblers 23 each having two elements. The first element is a key-engaging element 6 that can engage the coded surface 149 of a key 101. The second element can be a housing-engaging element 104 that can releasably engage the housing 114 in a locked position of the housing-engaging element 104. Prior to coding, the key-engaging elements 106 may be pivotable independently of the housing-engaging elements 104. Specifically, the key-engaging elements 106 can be pivotally connected to a bar shaped follower 170 inside the barrel 130. The key-engaging tumbler elements 106 can also be biased by a spring 112, if desired. Also, the housing-engaging elements 104 can be located within, guided by, and supported by the barrel 130.

The key-engaging tumbler elements 106 can have at least one projection and/or recess 157 for selective engagement with one or more recesses and/or projections 154, respectively, on the housing-engaging elements 104 to engage the housing-engaging elements 104 in the coded state. The projections and/or recesses 157 of the key-engaging tumbler elements 106 can be located anywhere in on the key-engaging tumbler elements 106, but in some other embodiments they are located on ends of the key-engaging tumbler elements 106 opposite the pivot 108. Although the barrel 130 of the lock assembly 129 can have tumblers 123 positioned to contact a coded surface on only one side of a key 101, the barrel 130 of some embodiments has tumblers 123 that are positioned to contact coded surfaces on opposite sides of a key 101 (e.g., having alternating key-engaging tumbler elements 106 positioned to pivot in opposite directions upon contact with a key 101). As illustrated in the embodiment shown in FIG. 14E, the housing-engaging elements 104 can be extendable into a groove, recess, or other aperture of the housing 114, thereby engaging the housing 114 in a locked mode of the lock assembly 129. For tumblers 123 having two or more elements, at least one of the tumbler elements is shaped to engage the housing 114 in this manner. With continued reference to FIGS. 14A–14E for example, a portion of each housing-engaging tumbler element 104 can be shaped to be received within a recess, groove, or other aperture in the housing 114.

Figure 14A:
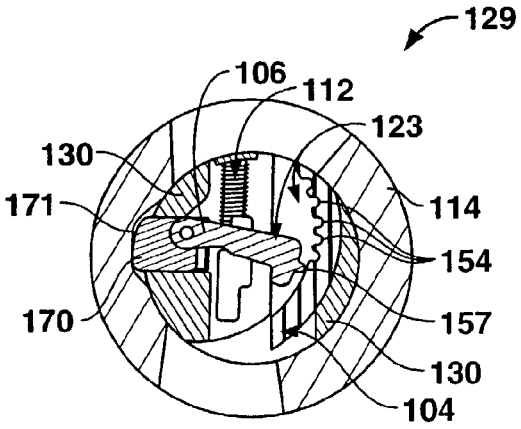
FIG. 14A is a front cross-sectional view of a codeable tumbler lock assembly according to a second embodiment of the present invention, shown prior to coding and without a key inserted therein.
Figure 14C:
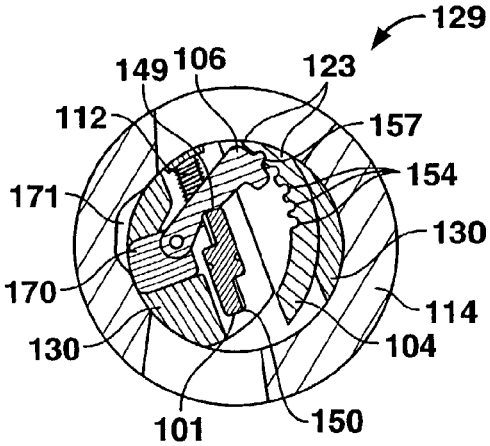
FIG. 14C is the cross-sectional view of the assembly illustrated in FIG. 14A, shown with a key inserted therein and with the tumbler shifting assembly activated.
Figure 14B:
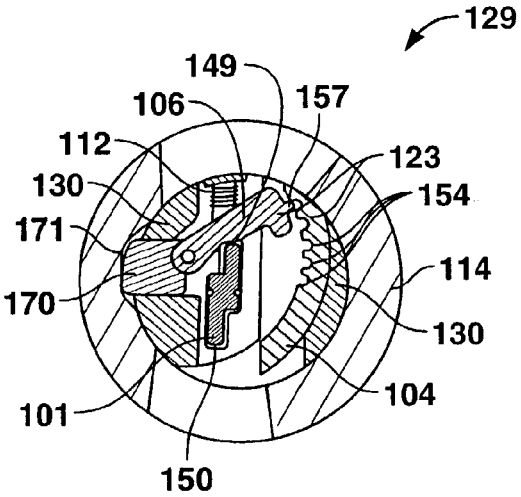
FIG. 14B is the cross-sectional view of the assembly illustrated in FIG. 14A, shown with a key inserted therein and prior to being coded.

The lock assembly 129 in the embodiment illustrated in FIGS. 14A–14E can be assembled in the uncoded condition as shown in FIGS. 14A and 14B, with the housing-engaging elements 104 contained within the barrel 130 by the housing 114. As such, the follower 170 is received within a recess, groove, or other aperture 171 in an interior wall of the housing 114.

Figure 14D:
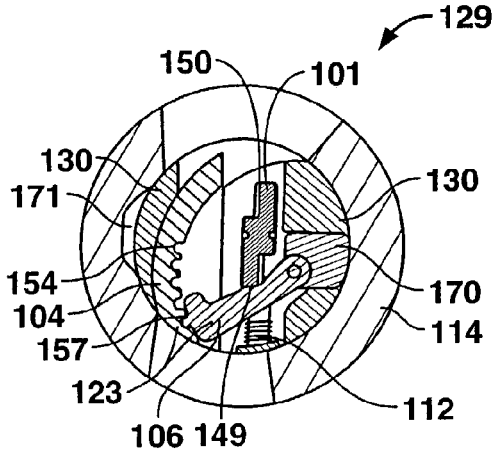
FIG. 14D is the cross-sectional view of the assembly illustrated in FIG. 14A, shown with a key inserted therein and after being coded.
Figure 14E:
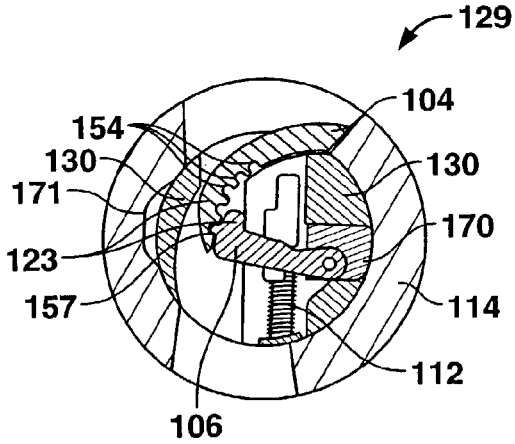
FIG. 14E is the cross-sectional view of the assembly illustrated in FIG. 14A, shown without a key inserted therein and after being coded.

To set the code for the lock assembly 129 shown in FIGS. 14A–14E, a key 101 is inserted into the barrel 130 and the key-engaging elements 106 pivot relative to the coded surfaces 149, 150 of the key 101 as shown in FIG. 14B. Once the key 101 is fully inserted, the projection(s) and/or recess(es) 157 on the key-engaging elements 106 can align with corresponding projection(s) and/or recess(es) 154 on the housing-engaging elements 104. As shown in FIGS. 14C and 14D, the key 101 is then rotated along with the barrel 130 inside the housing 114, which causes the follower 170 to be radially driven into the barrel 130 by a cam surface on the housing 114. The follower 170 causes the projection(s) and/or recess(es) 157 on the key-engaging elements 106 to become engaged with corresponding projection(s) and/or recess(es) 154 on the housing-engaging elements 104 for the corresponding key notch depths at each tumbler position in the barrel 130. In the illustrated embodiment of FIGS. 14A–14E, the barrel 130 is then rotated approximately 180° to a neutral locked state, although such a state can be located at smaller or larger angles in other embodiments. In some embodiments, the useable range of barrel rotation can be ±60° after coding. However, other ranges of rotation fall within the spirit and scope of the present invention. Thus, in other embodiments, this range is greater or smaller depending at least partially upon the positions of the housing apertures in which the tumblers 123 are received and the shape of the tumblers 123. As shown in FIGS. 14D and 14E, after coding, the follower 170 remains in its radially inward position, retained in this position by the interior walls of the housing 114. Therefore, the tumbler combinations 123 can remain engaged in their coded positions as the key 101 is inserted into and extracted from the barrel 130.

To change the code of the lock assembly 129, the correct key 101 can be used to unlock the lock and to permit the barrel 130 to be rotated to the original coding position. The key 101 is then extracted and a new key is inserted. The barrel 130 is then rotated to code the lock assembly 129 to the new key in a manner as described above.

Figure 15:
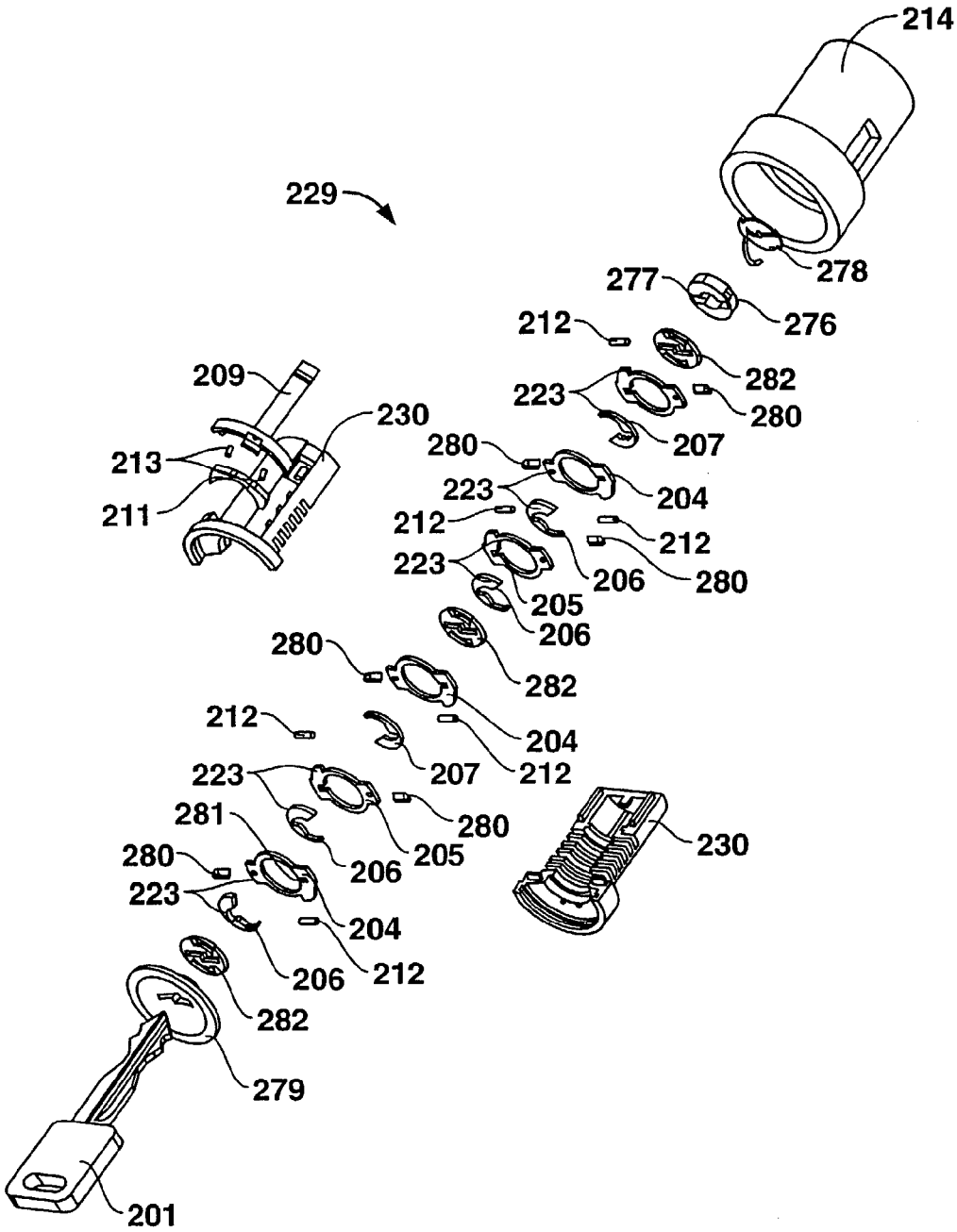
FIG. 15 is an exploded front perspective view of a codeable tumbler lock assembly according to a third embodiment of the present invention.
Figure 16:
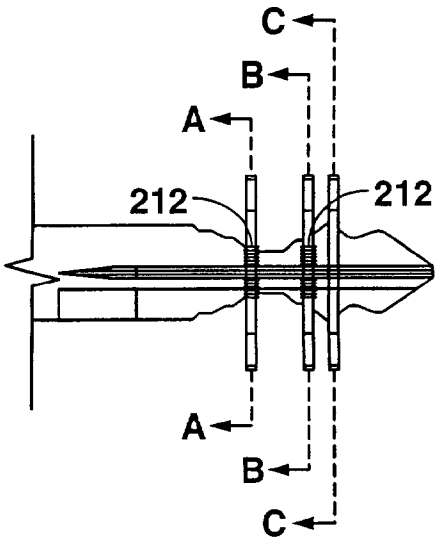
FIG. 16 is a side view of part of a key used in the codeable tumbler lock assembly shown in FIG. 15, showing the positions of three tumblers of the codeable tumbler lock assembly illustrated in FIG. 15 when the key is inserted within the assembly.

Yet another embodiment of a codeable lock according to the present invention is illustrated in FIGS. 15–17. As with the other embodiments illustrated in FIGS. 1–14, this embodiment also uses pivotable two-piece tumblers 223 to provide for coding after assembly of the lock assembly 229. Like the previous embodiments, the embodiment illustrated in FIGS. 15–17 has a barrel 230, a housing 214, and pivotable tumblers 223. However, unlike the previous embodiments described above and illustrated in FIGS. 1–14, the tumblers 223 can pivot during the coding process and translate during normal operation of the lock assembly 229. Each pivotable two-piece tumbler 223 can include a housing-engaging element 204, 205 and a key-engaging element 206, 207. In some embodiments, the key-engaging elements 206, 207 are pivotable within the housing-engaging elements 204 and 205 prior to coding the lock assembly 229.

To code the lock assembly 229 of the embodiment illustrated in FIGS. 15–17, a key 201 is inserted into the uncoded lock assembly 229. As the key 201 is inserted, it passes the tumblers 223 in the barrel 230. In some embodiments such as that shown in FIGS. 15–17, the key 201 also passes through a bezel 279 or face plate prior to passing the tumblers 223. If desired, spacer elements 282 can be positioned between tumblers 223 and can have apertures shaped to receive the key 201 therethrough. Once the key 201 is inserted into the lock assembly 229, the tip of the key 201 can contact a clutch plate 276. The clutch plate 276 can be spring loaded (by one or more springs 278) against force exerted by the key 201. The spring(s) can be of any type, including without limitation coil, leaf, torsion, and the like. For example, the spring 278 in the embodiment illustrated in FIGS. 15–17 can be a leaf spring 278 extending from a base received within the housing 214.The clutch plate 276 may be moved rearwardly by entry of the key 201 into the barrel, thereby compressing the spring 278.

As illustrated in this embodiment, the clutch plate 276 can have an aperture 277 initially misaligned with respect to the tip of the key 201. Specifically, the aperture 277 has a shape that can receive the tip of the key 201 when properly rotationally aligned therewith. In the illustrated embodiment for example, the aperture 277 is elongated and can receive the tip of the key 201 at a rotational angle of the key 201. Other aperture shapes 277 can also be employed to match and receive the tip of a key 201 in a similar manner. The amount of misalignment between the tip of the key 201 and the aperture 277 in the clutch plate 276 may correspond to the amount of rotation of the key 201 during the coding process (described in greater detail below). In the illustrated embodiment for example, this amount of misalignment is approximately 130 degrees, although larger or smaller amounts of misalignment are possible.

As the key 201 is rotated within the barrel 230 of the illustrated embodiment of FIGS. 15–17, the key 201 begins to contact the key-engaging elements 206, 207, which causes the key-engaging elements 206, 207 to rotate with respect to the housing-engaging elements 204, 205. In some embodiments, the barrel 230 does not rotate with the key 201 in this stage of coding. Instead, the bezel 279 (if used), the key-engaging elements 206, 207, and the spacers 282 (if used) can rotate with the key 201. In some embodiments, the barrel 230 can be prevented from rotating with respect to the housing 214 by a housing engagement assembly 209. The housing engagement assembly 209 may be located on the barrel 230, and can be employed to prevent the barrel 230 from rotating with respect to the housing 214 until the housing engagement assembly 209 has been moved. In the illustrated embodiment, the housing engagement assembly 209 is an elongated element which is received within a groove, slot, recess, or other aperture in the barrel 230 and can move axially therein.

Figure 17C:
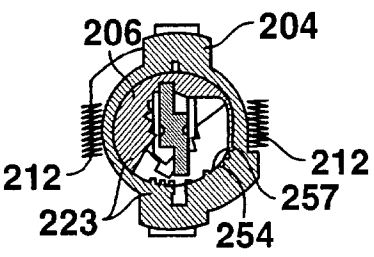
FIG. 17C is a front cross-sectional view of the codeable tumbler lock assembly shown in FIG. 16, taken along lines C—C of FIG. 16.
Figure 17B:
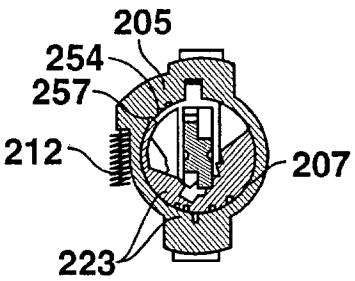
FIG. 17B is a front cross-sectional view of the codeable tumbler lock assembly shown in FIG. 16, taken along lines B—B of FIG. 16.
Figure 17A:
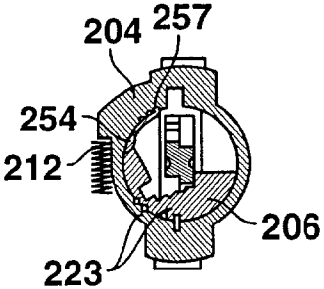
FIG. 17A is a front cross-sectional view of the codeable tumbler lock assembly shown in FIG. 16, taken along lines A—A of FIG. 16.

The amount each key-engaging element 206, 207 rotates, which determines the coding of the lock assembly 229, is related to the depth of the cut in the key 201 at the location of that tumbler element 206, 207 along the key 201 when the key 201 has been inserted within the barrel 230. With reference to FIGS. 17A–17C, the greater the depth of the cut in the key 201, the less the key-engaging element 206, 207 rotates because the key 201 does not contact the key-engaging element 206, 207 until later in the rotation of the key 201. As the key-engaging elements 206, 207 rotate within the housing-engaging elements 204, 205, projections 57 on the tails of the key-engaging elements 206, 207 can engage recesses 254 in the housing-engaging elements 204, 205. This engagement can at least temporarily retains the key-engaging elements 206, 207 in their coded positions with respect to the housing-engaging elements 204, 205.

After the key 201 has been rotated sufficiently to align the tip of the key 1 with the aperture 277 in the clutch plate 276, the tip of the key 201 can enter the aperture 277. In the illustrated embodiment, the spring 278 presses the clutch plate 276 toward the key 201 to create this engagement. As the clutch member 276 moves towards the key 201, the clutch member 276 can push and move the housing-engaging assembly 209 with respect to the barrel 230. In the illustrated embodiment, the housing-engaging assembly 209 moves within a groove, slot, recess, or other aperture in the barrel 230 away from the spring 278. This movement can cause the housing-engaging assembly 209 to disengage from the barrel 230, thereby permitting rotation of the barrel 230 with respect to the housing 214. This movement can also cause a bezel-engaging element 211 to engage a shoulder or a notch, recess, groove, slot, or other aperture on the bezel 279, thereby establishing a mechanical connection between the bezel 279 and the barrel 230 in order to turn the barrel 230 with the key 201. This connection can also establish the bezel's orientation with respect to the barrel 230. The bezel-engaging element 211 can be one or more spring-loaded pins, clips, fingers, and the like extending into engagement with the bezel 279. Alternatively, the bezel-engaging element 211 can be a member (as shown in FIG. 15) that is spring-loaded (e.g., with one or more springs 213) toward the bezel 279 and that is shaped to mate with the bezel 279 to transmit torque from the bezel 279 to the barrel 230. Other shapes of the bezel-engaging element 211 are possible and fall within the spirit and scope of the present invention.

Further rotation of the key 201 may rotate the barrel 230 through another angle, which can generates a camming action between internal surfaces of the housing 214 and a plurality of keepers 280 located adjacent to the tumblers 223. This camming action is similar to the relationship between the key-engaging elements 6, 7 and the housing 14 in the embodiment of the present invention illustrated in FIGS. 1–13, and the relationship between the follower 170 and the housing 114 in the embodiment of the present invention illustrated in FIGS. 14A–14E. In particular, the keepers 280 can cam against the housing 214 and are thereby moved into spaces defined between the housing-engaging elements 204, 205 and the key-engaging elements 206, 207. The keepers thereby secure the key-engaging elements 206, 207 in position with respect to the housing-engaging elements 204, 205 in order to code the tumblers 223. Upon key removal, springs 212 or other resilient biasing members can bias the tumblers 223 to positions where they engage the housing 214.

In operation of the lock assembly 229 illustrated in FIGS. 15–17, the key 201 is inserted into the barrel 230. As the key 201 is inserted, the key 201 engages the key-engaging elements 206, 207, which causes the tumbler combinations 223 to translate with respect to the barrel 230 and housing 214. After the key 201 has been inserted, the housing-engaging elements 204, 205 of the tumbler combinations 223 are retracted into the barrel 230, which allows the barrel 230 to rotate with the key 201 to unlock the lock assembly 229.

The above-described lock assembly embodiments each employ one or more tumblers that pivot at some point during the process of coding the lock assembly. Other embodiments of the present invention employ codeable tumblers that move linearly or primarily linearly during coding. The embodiment shown in FIGS. 18A–18E is one such embodiment. Like the illustrated embodiments described above, the lock assembly 329 illustrated in FIGS. 18A–18E can have a housing 314, a barrel 330, and one or more tumblers 323 within the barrel 330. Each tumbler 323 can be defined by two or more elements movable with respect to one another for purposes of coding. In the illustrated embodiment for example, each codeable tumbler combination 323 includes a key-engaging element 306, 307 and a housing-engaging element 304, 305. These elements can be guided and supported by the barrel 330 as shown.

The key-engaging elements 306, 307 can each have at least one key-engaging surface 356 and one or more projections and/or recesses 357 to engage the housing-engaging elements 304, 305. Similarly, the housing-engaging elements 304, 305 can each have at least one surface with one or more projections and/or recesses 354 to engage the key-engaging elements 306, 307 during the coding process. Although the elements 304, 305, 306, 307 can have any shape as described in greater detail above with reference to illustrated embodiment of FIGS. 1–13, the engaging surfaces of the key-engaging elements 306, 307 and the housing-engaging element 304, 305 may be arc-shaped. In other words, the engaging surface of the key-engaging elements 306, 307 can be concave or convex for engagement with a convex or concave surface of the housing-engaging elements 304, 305, respectively. One example of such tumbler element shapes is illustrated in FIGS. 18A–18E. The arc-shaped interface between these tumbler elements can provide larger engagement surfaces for the elements 304, 305, 306, 307 for more possible codings and/or for improved engagement. In some embodiments, the housing-engaging elements 304, 305 are movable to engage the housing 315 (e.g., each housing-engaging element 304, 305 having a portion that can engage the housing 315 upon movement of the housing-engaging element 305, 305 to a locked position).

Figure 18A:
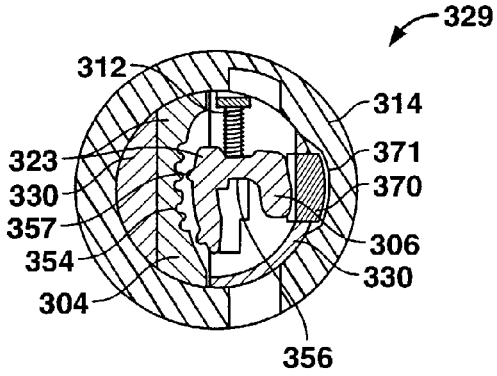
FIG. 18A is a front cross-sectional view of a codeable tumbler lock assembly according to a fourth embodiment of the present invention, shown prior to coding and without a key inserted therein.

As shown in FIG. 18A, the lock assembly 329 can be assembled with the tumbler combinations 323 in an uncoded condition. As such, the key-engaging elements 306, 307 are movable with respect to the housing-engaging elements 304, 305. In some embodiments, the key-engaging elements 306, 307 are biased by one or more coil springs 312 toward one position with respect to the housing-engaging elements 304, 305. Although one or more springs 312 may be employed for this purpose, various other biasing elements can be used, including without limitation leaf, torsion, and other types of springs, magnet sets, and the like. Prior to being coded, the housing-engaging elements 304, 305 can be located entirely or substantially within the periphery of the barrel 330, and are retained therein by the interior walls of the housing 314.

Figure 18D:
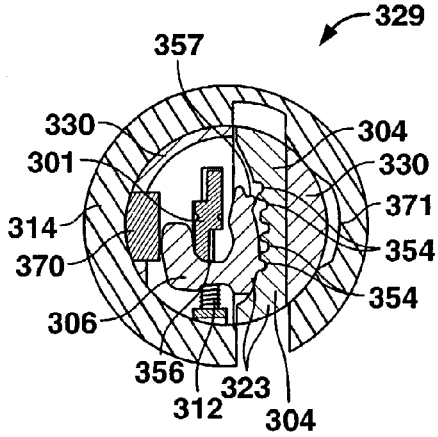
FIG. 18D is the cross-sectional view of the assembly illustrated in FIG. 18A, shown with a key inserted therein and after being coded.
Figure 18B:
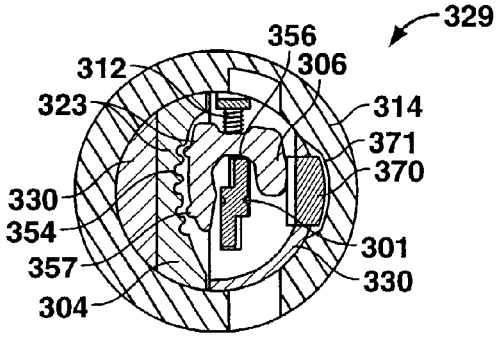
FIG. 18B is the cross-sectional view of the assembly illustrated in FIG. 18A, shown with a key inserted therein and prior to being coded.
Figure 18E:
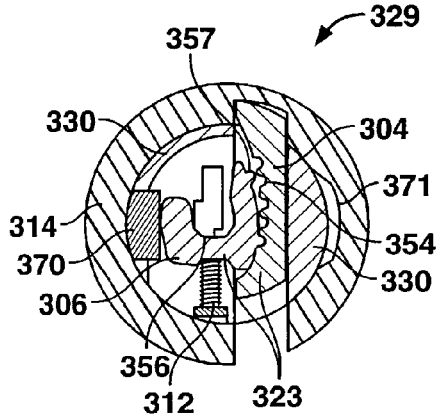
FIG. 18E is the cross-sectional view of the assembly illustrated in FIG. 18A, shown without a key inserted therein and after being coded.

To code the lock assembly 329 illustrated in FIGS. 18A–18E, a key 301 is inserted into the barrel 330 as shown in FIG. 18B. As the key 301 is inserted, the coded surfaces of the key 301 engage the key-engaging surfaces 356 of the key-engaging elements 306, 307. The key-engaging elements 306, 307 react by translating and pivoting slightly under force exerted by the key 301. Once the key 301 has been inserted, at least one projection or recess 357 on each key-engaging member 306, 307 is aligned with a recess or projection 354, respectively, on a corresponding housing-engaging member 304, 305. In some embodiments, more than one projection or recess 357 on each key-engaging member 306, 307 is aligned with more than one recess or projection 354 on a corresponding housing-engaging member 304, 305. In still other embodiments, one or more projections or recesses 357 on the key-engaging members 304, 305 are aligned with one or more projections or recesses 354 on corresponding housing-engaging members 304, 305, although in such embodiments at least one recess and projection pair is aligned in each tumbler in order to provide engagement between the tumbler elements 304, 306 and 305, 307. Such an arrangement is illustrated by way of example in FIGS. 18A–18E, which show a projection 357 of a key-engaging element 306, 307 in tip-to-tip contact with a projection of a housing-engaging element 304, 305, and another projection 357 of the key-engaging element 306, 307 in tip-to-recess contact with a recess of the housing-engaging element 304, 305 (although this can be a recess-to-tip relationship in other embodiments).

As described above, entry of the key 301 into the barrel 330 of the lock assembly 329 can cause the key-engaging surfaces 356 of the key-engaging elements 306, 307 to move with respect to the housing-engaging elements 304, 305. The amount of movement of the key-engaging elements 306, 307 may be dependent at least partially upon the key depth at each key-engaging element 306, 307. In some embodiments, the key-engaging elements 306, 307 can be positioned in the barrel 330 to pivot in different directions upon entry of the key 301. In these and other embodiments, some of the key-engaging elements 306 can be positioned in the barrel 330 to contact one side of the key 301 while other key-engaging elements 307 can be positioned in the barrel 330 to contact an opposite side of the key 301. By arranging the tumbler elements in such a manner, more code sequences are possible compared to coding using only one side of the key 301.

Figure 18C:
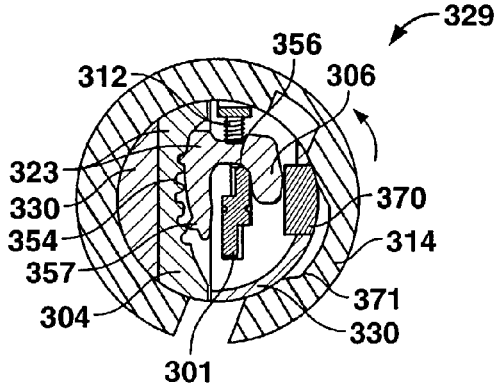
FIG. 18C is the cross-sectional view of the assembly illustrated in FIG. 18A, shown with a key inserted therein and with the tumbler shifting activated.

Although the key-engaging elements 306, 307 in the embodiment illustrated in FIGS. 18A–18E can be urged into engagement with the housing-engaging elements 304, 305 in any of the manners described above with respect to other multiple-piece tumblers, the key-engaging elements 306, 307 can be engaged with the housing-engaging elements 304, 305 by a camming arrangement between a follower and one or more surfaces of the housing 314. With reference to FIGS. 18B and 18C for example, an inserted key 301 can be rotated to rotate the barrel 330 with respect to the housing 314. As the barrel 330 rotates, a follower 370 may ride upon an inner surface of the housing 314. As illustrated, the follower 370 can be in the shape of a bar. The inner surface is preferably shaped to inwardly cam the follower 370. In this regard, the follower 370 can be received within a groove, recess, or other aperture 371 in the housing 314 prior to the coding process. As the follower 370 is moved in this manner, the follower 370 can force the key-engaging members 306, 307 to engage the housing-engaging members 304, 305.

In some embodiments, the barrel 330 is rotated until the housing-engaging elements 304, 305 are positioned with respect to the housing 314 to that they can be extended into engagement with the housing in order to prevent rotation of the barrel 330 with respect to the housing. In the embodiment illustrated in FIGS. 18A–18E, the barrel 330 is rotated approximately 180 degrees for this purpose, although larger or smaller rotations are possible depending at least partially upon the initial positional relationship between housing-engaging elements 304, 305 and the housing 314.

After the barrel 330 has been rotated as just described, the tumbler elements 323 remain engaged when the key 301 is extracted from the barrel 330 due to the inward position of the follower 370 (see FIG. 18D). When the key 301 is removed, the spring 312 may bias the tumbler elements 323, which then can cause the housing-engaging elements 304, 305 to engage the housing 314, such as by entering one or more grooves, recesses, or other apertures in the housing 314. This engagement prevents the barrel 330 from rotating with respect to the housing 314 without the key 301 in the barrel 330. The useable range of barrel rotation is approximately ±60° in the embodiment illustrated in FIGS. 18A–18E, although smaller or larger usable ranges of barrel rotation are possible in other embodiments of the present invention.

To change the code of the lock assembly 329, the key 301 that the lock assembly 329 is coded to can be used to unlock the lock assembly 329 and to rotate the barrel 30 back to its coding position (see for example, FIGS. 18A and 18B). The key 301 can then be extracted and another key with a different code can be inserted. Next, the same steps discussed above can be followed to code the lock assembly 329 with the different key 301. After rotation back to the useable range of barrel rotation, only the new key 301 will unlock the lock assembly 329.

Figure 19:
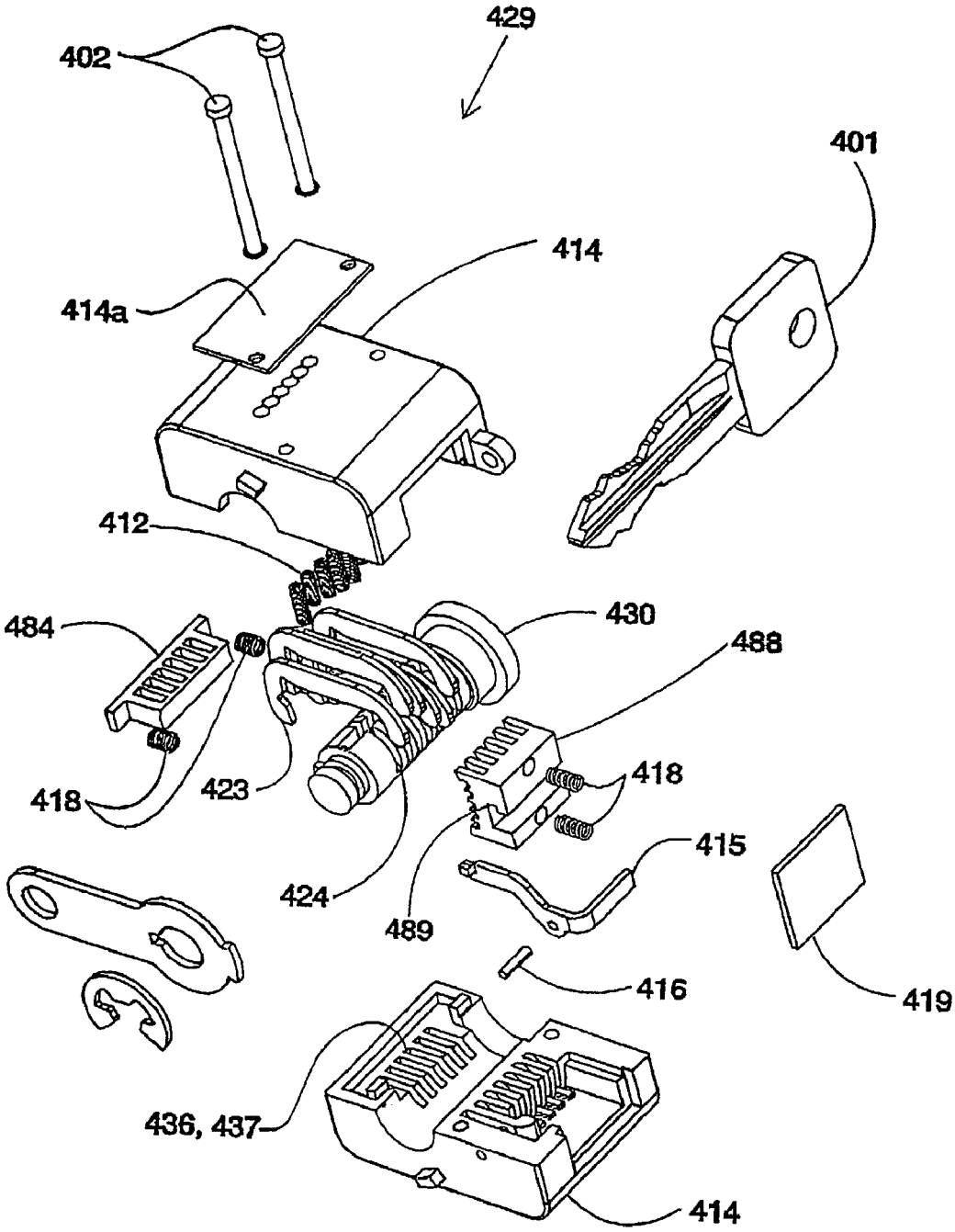
FIG. 19 is an exploded perspective view of a codeable tumbler lock assembly according to a fifth embodiment of the present invention.

Another embodiment of a pivotable tumbler lock assembly according to the present invention is illustrated in FIGS. 19–21. Like the tumbler lock assembly 29 in the embodiments illustrated in FIGS. 1–18, the embodiment illustrated in FIGS. 19–21 employs pivotable tumblers 423. However, unlike the previous embodiments, the tumblers 423 are located substantially outside of the barrel 430, and can have portions extending within the barrel 430. The tumblers 423 in the illustrated embodiment of FIGS. 19–21 are located within the housing 414, and are pivotable about locations external to the barrel 430.

With reference first to FIG. 19, the lock assembly 429 of the present embodiment has a housing 414 that accommodates and supports various working components of the lock assembly. For example, the housing 414 can accommodate a barrel 430 selectively rotatable with respect to the housing 414 and one or more pivotable tumblers 423. In the illustrated embodiment of FIGS. 19–21, a sidebar 484 and an indexed pivot guide 488 is also located within the housing 414. The sidebar 484 is movable to engage the barrel 430 in a locked state in which the barrel 430 is restricted from rotation with respect to the housing 414. The housing 414 can have an aperture within which the barrel 430 is axially received, or can be otherwise shaped to receive the barrel 430. In addition to housing the pivotable tumblers 423, the housing 414 can also house one or more resilient biasing members (such as springs 412) positioned to bias some or all of the pivotable tumblers 423 in a direction generally toward the barrel 430. In some embodiments such as the embodiment illustrated in FIG. 19, the biasing members can be inserted within one or more apertures of the housing 414 and held in place by a housing plate 414*a*. In some embodiments, the housing 414 has a plurality of internal grooves 436, 437 that accept and receive portions of the pivotable tumblers 423 for maintaining the pivotable tumblers 423 in proper arrangement.

As shown in FIG. 19, the housing 414 can be constructed in two or more sections joined together in any manner, such as by rivets, stakes or crimps (whether using the parent material of the housing portions or not), welds, screws, bolts, snap-fit connections, adhesive or cohesive bonding material, bands, clips, pin and aperture connections, and the like. As illustrated in FIG. 19, the housing 414 of the exemplary embodiment is held together by two pins 402 The housing 414 can instead be defined by a single element manufactured in any conventional manner (e.g., molded, machined, cast, and the like).

As illustrated in FIGS. 19–21, the housing rotatably supports a barrel 430. The barrel 430 can also have one or more grooves 424 through which key-engaging surfaces of the tumbler 423 extend as shown. If desired, the key-engaging surfaces of the tumblers 423 can be biased into these grooves 424 in the locked condition by springs 412. Although the tumblers 423 in the illustrated embodiment are received within grooves 424 of the barrel 430 in order to contact a key 401 inserted therein, any other barrel shape enabling contact between the tumblers 423 and a key 401 inserted in the barrel is possible (e.g., through a slot running along the barrel 430, a series of holes in the barrel 430 through which extensions of the tumblers 423 are received to contact a key 401 therein, and the like). In this regard, the tumblers 423 need not necessarily contact the barrel 430. However, the key 401 does not necessarily have to directly contact the tumblers 423 of this embodiment or any other embodiment of the present invention. Rather, indirect contact through an intermediate element can be sufficient. For example, the key 401 can have contact with a follower or other member, which in turn contacts and moves the tumblers 423.

Although the tumblers 423 are biased toward the barrel 430 in the illustrated embodiment of FIGS. 19–21C, the contact (if any) between the barrel 430 and the tumblers 423 does not necessarily prevent the barrel 430 from rotating. However, it should be noted that the tumblers 423 can be shaped and oriented to contact and engage the barrel 430 in the locked state of the assembly 429 such that rotational movement of the barrel 430 is restricted or prevented in the locked condition. As will described in greater detail below, a sidebar 484 can be employed to prevent the barrel 430 from rotating with respect to the housing 414. The sidebar 484 can prevent the barrel 430 from rotating by being received within a groove, recess, or other aperture or feature of the barrel 430. In some embodiments, it is the engagement between the sidebar 484 and the barrel 430 that prevents barrel rotation in the locked state of the assembly 429.

Figure 21C:
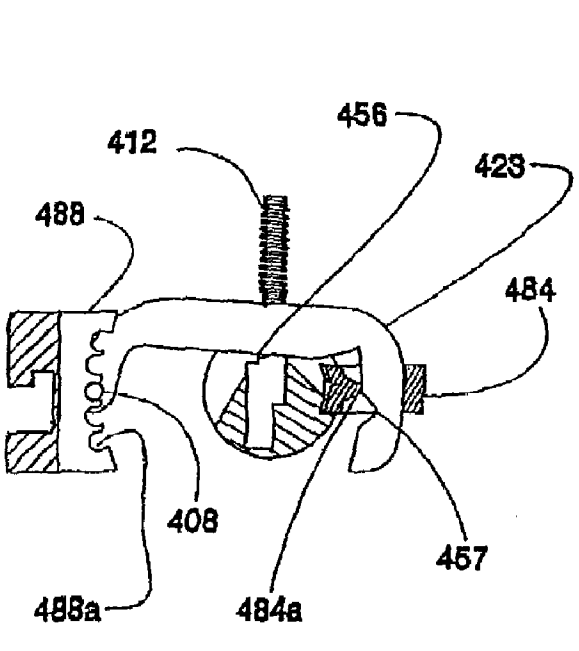
FIG. 21C is the cross-sectional view of the lock assembly illustrated in FIG. 21A, shown with the assembly in a coded and locked state.
Figure 21B:
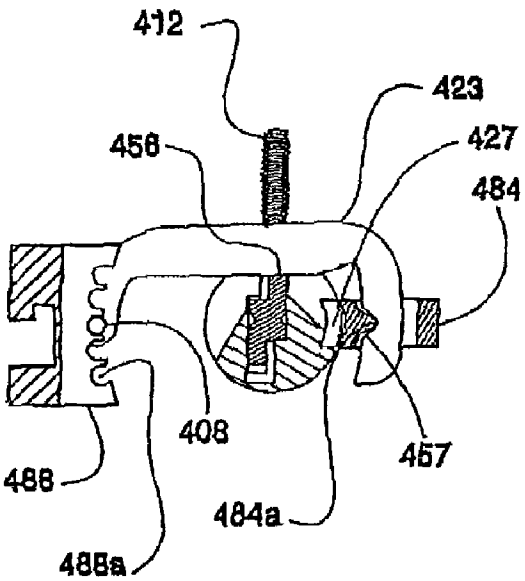
FIG. 21B is the cross-sectional view of the lock assembly illustrated in FIG. 21A, shown with the assembly in a coded and unlocked state.
Figure 21A:
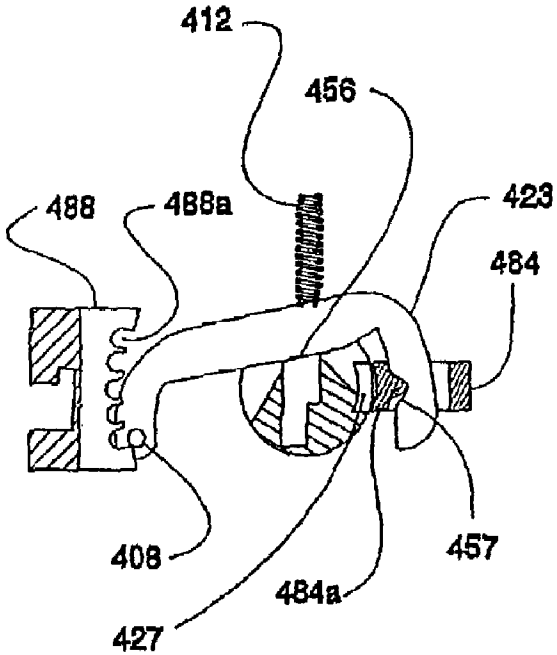
FIG. 21A is a cross-sectional view of the lock assembly illustrated in FIGS. 19 and 20, showing a tumbler in the uncoded state.

With reference now to FIGS. 21A–21C, each tumbler 423 in the illustrated embodiment has a trunion portion 408, a sidebar-engaging portion 457, and key-engaging portion 456. In some embodiments, the key-engaging portion 456 of each tumbler 423 extends between the trunion portion 408 of the tumbler 423 and the sidebar-engaging portion 457. The key-engaging portions 456 of the tumblers 423 can be received within the barrel grooves 424 as discussed above. The key-engaging portion 456 of each tumbler 423 has a surface that contacts the coded portion of a key inserted in the barrel 430.

A portion of the illustrated tumbler 423 has a trunion 408 which can help set the code of the lock assembly in some embodiments and serve as a pivot in other embodiments. As shown in the illustrated embodiment of FIGS. 19–21, the trunion 408 can be located at one end of the tumbler 423. However, the trunion 408 can be located in other positions on the tumbler 423 if desired. In some codeable embodiments as illustrated and described in greater detail below, the trunion 408 aligns with and engages a pivot guide 488 to determine the code of the lock. Once the lock is in the coded condition, the tumblers 423 in the illustrated embodiment of FIGS. 19–21 pivot about the trunion 408 which is pivotally supported in a groove 488*a* of the pivot guide 488.

Figure 20A:
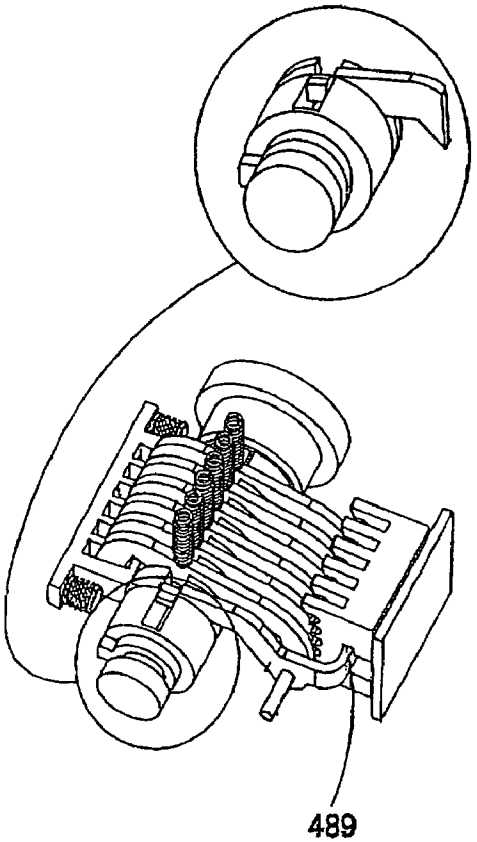
FIG. 20A is a partial rear perspective view of the lock assembly illustrated in FIG. 19 with the housing removed, shown in an uncoded state.

The pivot guide 488 is best shown in FIGS. 19, 20A, and 21. As illustrated in this embodiment, the pivot guide 488 can have one or more grooves 488*a* for receiving the trunion 408 of each tumbler 423 in different positions with respect to the pivot guide 488. The locations of the grooves in the pivot guide can determine the code of each tumbler. In some embodiments, multiple indexed grooves 488*a* are provided to allow for a number of different coding possibilities. These multiple indexed grooves 488*a* can be used both in pre-coded embodiments and in codeable embodiments. Regardless of the embodiment, multiple grooves 488*a* allow the trunions 408 to be movable to different locations with respect to the indexed pivot guide 488 prior to coding without having to add or remove materials (tumblers or pivot guides) from the lock.

The interaction of the pivot guide 488 and the trunions 408 will now be briefly discussed with reference to the illustrated codeable embodiment of FIGS. 19–21. As will be discussed in greater detail below, when a key 401 is inserted into the barrel 430 during the coding process, the tumblers 423 pivot and the trunions 408 move with respect to the indexed pivot guide 488. Once the key 401 is fully inserted, each trunion 408 is positioned with respect to a groove 488*a* on the indexed pivot guide 488 corresponding to the code of the key 401. The trunions 408 and the indexed pivot guide 488 can then be brought into engagement with one another. In some embodiments, the pivot guide 488 is biased into engagement with the tumblers 423. For example, as illustrated in FIG. 19, one or more springs 418 contained within the housing by enclosure plate 419 can bias the pivot guide 488 into engagement with the tumblers 423. When the lock is coded in this manner, the pivot guide 488 and the tumblers 423 are held in engagement even after the key 401 is removed.

Although the description regarding the engagement between the tumblers and the pivot guide of the illustrated embodiment of FIGS. 19–21 have been described with reference to trunions and grooves, other embodiments of the present invention use other arrangements and structures for this engagement between the key-engaging portion 456 and sidebar-engaging portion 457 of the tumblers 423. By way of example only, one or more grooves can be provided on each tumbler 423 which is engagable with a pin or other pivot element on pivot guide 488 (e.g., a structure that is the reverse of what is illustrated in FIGS. 19–21). As another example, other embodiments can utilize inter-engaging teeth on the tumbler portions 456, 457, a friction fit between these elements, or any other manner of engagement enabling pivoting motion between these elements.

As mentioned above, yet another portion of each tumbler 423 in the illustrated embodiment of FIGS. 19–21 interacts with a sidebar 484. The sidebar 484 is similar to most conventional sidebars in many respects. Therefore, the operation of the sidebar 484 will not be discussed in great detail. Like most conventional sidebar locks, each tumbler 423 can have a portion that mates with the sidebar 484 in a male-female relationship in the unlocked state. By way of example only, a notch 457 with a mating projection 484*a* is employed in the illustrated embodiment of FIGS. 21A–21C. However, the structure can be reversed so that the notch is on the sidebar 484 and the mating projection is on the tumbler 423. When the proper key is inserted into the lock, the notch 457 and projection 484*a* are in a mating relationship and the sidebar 484 can be biased into an unlocked condition (i.e., out of engagement with the barrel 430).

However, as the proper key 401 is removed from the barrel 430, each tumbler 423 is biased to a locked position. As the tumblers 423 pivot to their locked positions, the mating relationship between the notch 457 on the sidebar-engaging portion of the tumbler 423 and the projection 484*a* on the sidebar 484 is disrupted. This disruption occurs because the notch 457 cams past the projection 484*a*. The forces generated by the notches 457 camming out of alignment with the projection 484*a* of the sidebar 484 cause the sidebar 484 to move to a locked condition. The sidebar moves to the locked condition because the biasing force of the tumblers 423 into the locked condition is greater than the biasing force of sidebar 484 into the unlocked position. Thus, in the locked condition, the notch 457 in the sidebar-engaging portion of the tumbler 423 is out of alignment with a projection 484*a* of the sidebar 484.

Unlike conventional sidebar locks which bias the sidebar radially outward into engagement with the housing from within the barrel, the sidebar 484 in the illustrated embodiment is biased radially inwardly into engagement with the barrel 430 from within the housing 414. Accordingly, in the locked state of the lock assembly 429, the sides of the sidebar 484 cooperate with the sides of the barrel groove 427 to prevent the lock barrel 430 from rotating relative to the housing 414. When a properly coded key 401 is installed, the notches 457 on the tumblers 423 become aligned (or substantially aligned) with the projection 484*a* of the sidebar 484, allowing the projection 484*a* of the sidebar 484 to be received in the notches 457 and for the sidebar 484 to retract from the barrel 430. With the sidebar 484 retracted, the lock barrel 430 can be rotated within the housing 414 to actuate the output mechanism.

The operation of the coded lock illustrated in this embodiment will now be discussed by way of example only. Assuming that the lock assembly is already coded, operation of the lock begins with the insertion of a properly coded key 401. As the key 401 is being inserted into the barrel 430, the coded surface of the key 401 begins to contact and interact with the key-engaging surfaces 456 of the tumblers 423. This interaction forces the tumblers 423 to pivot about the trunions 408 engaged with the indexed pivot guide 488, thereby moving at least part of each tumbler 423 in a radial direction with respect to the barrel 430. This motion in turn causes the sidebar-engaging surfaces of the tumblers 423 to cam against the sidebar 484. Once the properly coded key 401 is fully inserted, the notch 457 on the sidebar-engaging portion of each tumbler 423 becomes aligned (or substantially aligned) with the protrusion 484*a* on the sidebar 484, thereby enabling the sidebar 484 to move out of engagement with the barrel 430 until the protrusion 484*a* on the sidebar 484 rests in the notch 457 of each tumbler 423. Accordingly, the sides of the sidebar 484 are no longer received within the barrel groove 427, and the barrel 430 is free to rotate with respect to the housing 414 to cause actuation of an output mechanism.

To once again restrict relative motion between the barrel 430 and the housing 414 (i.e., place the assembly 429 in a locked state), the key 401 is rotated back to the original locked position and is removed. As the key 401 is removed, it causes the coded portion of the key 401 to no longer contact the key-engaging surfaces 456 of the tumblers 423. This allows the tumblers 423 to pivot about their trunions 408 and move toward the barrel 430 under biasing force of the tumbler springs 412. This pivoting further causes the sidebar-engaging surface of the tumblers 423 to interact with and cam the sidebar 484 in a radially-inward direction (toward the barrel 430) due to the misalignment between the mating surfaces of the sidebar-engaging portion and the sidebar 484. Specifically, the projection 484*a* of the sidebar 484 is forced out of the notches 457 of the tumblers 423 by the movement of the tumblers 423. Having been forced from the notches 457 of the tumblers, the sidebar 484 is biased radially towards the barrel 430 and engages the barrel groove 427 to prevent relative motion between the barrel 430 and the housing 414.

If a key 401 other than a properly coded key is inserted into the barrel 430 in the illustrated embodiment of FIGS. 19–21, the lock assembly 429 will not unlock because the sidebar 484 will not disengage the barrel 430. The sidebar 484 will not disengage the barrel 430 because the mating surfaces of the sidebar 484 (e.g., the projection 484*a* of the sidebar 484) and the sidebar-engaging portion of each tumbler 423 (e.g., the notches 457 of the tumblers 423) will not align. This misalignment forces the sidebar 484 to remain engaged with the barrel 430 as described above. Thus, since the sidebar 484 will not disengage the barrel 430, the barrel 430 cannot rotate with respect to the housing 414.

As shown in FIGS. 19–21, the tumblers 423 are only illustrated on one side of the barrel 430, and only engage one side of the key 401. However, this lock assembly 429 is shown with such a tumbler arrangement by way of example and illustration only. The tumblers 423 can be positioned on opposite sides of the barrel 430 so that the tumblers 423 engage opposite sides of the key 401 in an alternating or substantially alternating fashion.

As discussed above, one of the many advantages of this embodiment is that it is codeable. Therefore, the lock assembly 429 of the present invention can be assembled in the uncoded condition. In the uncoded condition of some embodiments, the mating surfaces of the sidebar-engaging portion of each tumbler 423 and the sidebar 484 are aligned, thereby permitting the sidebar 484 to be biased out of engagement with the barrel 430. When the sidebar 484 is moved out of engagement with the barrel 430 and the tumblers 423 are aligned with the sidebar projection 484*a*, the interface between the tumblers 423 and the sidebar 484 at the mating surface can provide a pivot point for the tumblers 423 in the uncoded state. In the illustrated embodiment, the tumblers 423 are therefore capable of pivoting about the sidebar 484 because the trunions 408 are not seated in the indexed pivot guide 488 in the uncoded condition. However, the tumblers 423 in some embodiments are prevented from pivoting on their own or from other forces in the uncoded condition due to the bias members 412 forcing the tumblers 423 radially toward the barrel 430. In such embodiments, the bias members 412 can be oriented to force the key-engaging surface of the tumblers 423 against the barrel 430.

As previously mentioned, when the tumblers 423 in the illustrated embodiment of FIGS. 19–21 are in their uncoded states, the tumblers 423 are able to pivot about the sidebar 484 because the trunions 408 are not seated in the pivot guide 488. The pivot guide 488 is held in the uncoded state, disengaged from the trunions by a lever or bar 415 shown in FIGS. 19 and 20. In some embodiments, an end of the lever 415 is positioned in an aperture 489 of the pivot guide 488. The aperture 489 can be a recess, groove, two position aperture, L-shaped aperture, and the like. When the lever 415 is in the aperture 489 or is otherwise in a select portion or range of positions in the aperture, the pivot guide 488 is held in a disengaged position with respect to the tumblers 423. Once the lever 415 is removed from the aperture 489 or a portion of the aperture 489, the pivot guide 488 is moveable to an engaged position with respect to the tumblers 423. In the illustrated embodiment of FIGS. 19–21, the lever 415 is engaged with a first portion of the aperture 489*a* to prevent the pivot guide 488 from engaging the tumblers 423 and is moveable to a second position to allow the pivot guide 488 to engage the tumblers 423. As illustrated, the lever 415 pivots about pivot pin 416 to allow the pivot guide 488 to engage the tumblers 423. Once the lever 415 pivots out of engagement with the aperture 489*a*, springs 418 bias the pivot guide 488 towards the tumblers 423.

As illustrated in FIGS. 19–21, the lever 415 can also be used to prevent rotation of the barrel 430 in the uncoded condition. As illustrated, an end of the lever 415 can be received within a recess, groove, slot, or other aperture in the barrel 430 that intersects the key slot to prevent the barrel 430 from rotating. Due to this arrangement, the key 401 can be used to move the lever 415 out of engagement with the barrel 430 during the coding process. As illustrated in FIG. 20A, the lever can be equipped with a finger that extends in an axial direction. When the lever 415 engages the barrel 430, the finger abuts a portion of the barrel 430 to prevent rotation of the barrel. This finger can take many shapes not illustrated. For example, the finger can also extend radially into a hole to prevent rotation of the barrel 430. Furthermore, the finger can be serrated and the barrel can have a mating serration to prevent rotation of the barrel 430 until it is coded. Still other manners of releasable engagement with the barrel 430 to prevent barrel rotation are possible, and fall within the spirit and scope of the present invention.

An exemplary manner in which the lever 415 can be moved in order to move the pivot guide 488 (or to allow the pivot guide 488 to move) is illustrated in FIGS. 19–21. With particular reference to FIG. 20, the lever 415 is moved by the key 401 as it is inserted into the barrel 430. In the illustrated embodiment, the lever 415 is not moved out of engagement with the barrel 430 until the key 401 is fully inserted. This ensures that the lock will be coded to the entire key 401. However, in other embodiments, it may be desirable to code only a portion of the key 401, in which case a length of the key 401 would be inserted into the lock in order to permit barrel rotation and to unlock the lock. In such embodiments, the position of the lever 415 with respect to the barrel 430 can be different so that the lever 415 is tripped at a different insertion point of the key 401 in the barrel 430. In still other embodiments, the lever 415 (or other mechanism by key insertion or rotation) is moved at a time other than upon partial or full insertion of the key 401.

As the lever 415 moves, it releases the pivot guide 488, allowing the pivot guide 488 to be moved towards the tumblers 423 and to engage the trunions 408. As the pivot guide 488 moves, the lever 415 moves to the second position of the aperture 489. In the second position as shown in FIG. 20C, the lever 415 engages a side wall 490 of the aperture 489, which prevents the lever 415 from moving back into the first position, and also prevents the end of the lever 415 nearest the barrel 430 from interfering with rotation of the barrel 430.

Although the same lever 415 is used in the illustrated embodiment to prevent the barrel 430 from rotating in the uncoded condition and to hold the pivot guide 488 in the disengaged position, other embodiments can use separate levers or other mechanisms for each function. For example, although the illustrated embodiment utilizes a lever 415 engaged with an aperture 489 to control the coding process, a number of other elements and assemblies can be employed to release the pivot guide 488 into engagement with the tumblers 423 in order to secure them in place. These elements and assemblies can be cammed by the key 401, rolled or pivoted off of the key 401, shifted by the key 401, tripped by the key 401, or can be moved in any other manner to release the pivot guide 488. In addition, these alternative elements and assemblies can move to permit the pivot guide 488 to engage the tumblers 423 by spring-loaded action, by pushing or pulling action upon the pivot guide 488 (e.g., by causing the pivot guide 488 to shift in the lock assembly), by only permitting the pivot guide 488 to move toward the barrel by another element or assembly (e.g., by later rotation of the barrel), and the like.

Figure 20B:
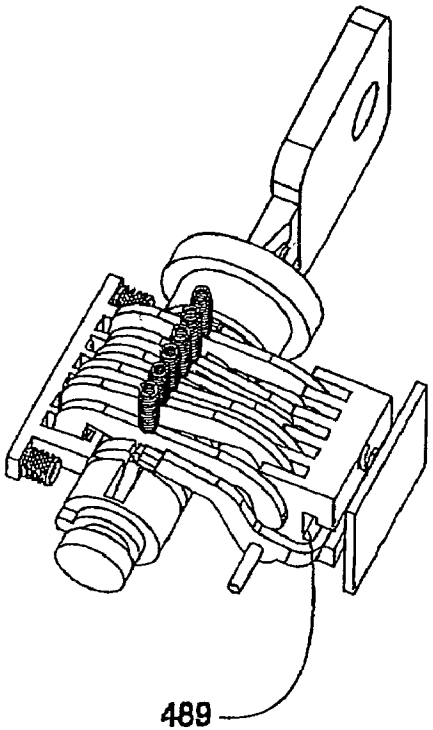
FIG. 20B is the partial rear perspective view of the lock assembly illustrated in FIG. 20A, shown with the assembly in a coded and unlocked state.
Figure 20C:
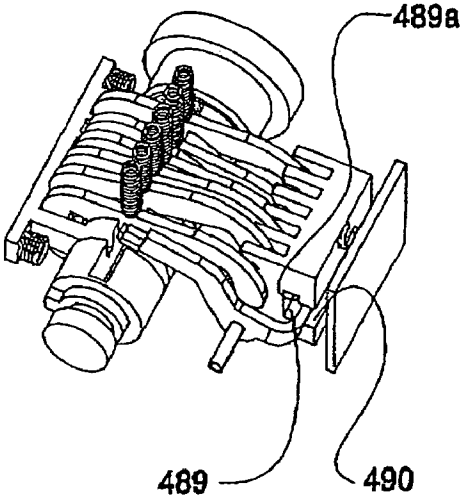
FIG. 20C is the partial rear perspective view of the lock assembly illustrated in FIG. 20A, shown with the assembly in a coded and locked state.

To code the exemplary lock assembly 429 illustrated in FIGS. 19–21, a key 401 is inserted into the barrel 430 of the lock assembly 429 as shown in FIGS. 20B and 21B. As the key 401 is inserted, the coded surfaces of the key 401 interact with the key-engaging surfaces 456 of the tumblers 423. This interaction causes the tumblers 423 to pivot about the notches 457 of the tumblers 423 engaging the sidebar 484. Once the key 401 is fully inserted, the key-engaging surface 456 of the tumblers 423 engage and rest against a portion of the coded surface of the key 401. Depending upon the code of the key 401, some of the tumblers 423 will rest in a greater radially extended position (with respect to the barrel 430) than others. This in turn causes the trunion 408 of each tumbler 423 to align with one of the many grooves in the indexed pivot guide 488, or otherwise be positioned in one of two or more different positions in which the trunion 408 can be secured. After the key 401 has been inserted in the illustrated embodiment, the lever 415 releases the barrel 430 for rotation and the pivot guide 488 for movement. As illustrated, the indexed pivot guide 488 can then move to engage the aligned trunions 408. Once the key 401 is removed from the barrel 430, the lock assembly 429 will remain coded. However, as the key 401 is being the removed, the lock assembly 429 transitions from the unlocked condition to the locked condition as discussed above.

In some embodiments, the lock assembly illustrated in FIGS. 19–21 can be uncoded and re-coded to a different key. By way of example only, one such way to uncode the lock assembly 429 would by to retract the pivot guide 488 in any suitable manner (e.g., by one or more levers connected thereto or pivotable to retract the pivot guide 488, by one or more pins, fingers, or other elements extending to the pivot guide 488 and movable to retract the pivot guide 488, by a modified aperture in which the lever 415 extends and which enables actuation of the lever 415 to cause retraction of the pivot guide 488, and the like). This would allow the coding process to start over with a new key.

Yet another embodiment of the present invention is illustrated in FIGS. 22–25. This embodiment utilizes a housing 514, a barrel 530, tumblers 523, and a sidebar 584. Much of the structure of the embodiment illustrated in FIGS. 22–25 is similar to those described above with reference to previous embodiments. With the exception of the structure and features described below, additional information regarding the lock assembly illustrated in FIGS. 22–25 can be found in the previously-described embodiments of the present invention.

The tumblers 523 in the embodiment of the present invention illustrated in FIGS. 22–25 are located in the barrel 530 and consist of two elements. The first element is a key-engaging element 506, 507 and the second element is a sidebar-engaging element 583. In the uncoded condition of the lock assembly, these elements 506, 507, 583 are disengaged from each other. In the coded state, however, the key-engaging tumbler elements 506, 507 and the sidebar-engaging tumbler elements 583 are secured to each other in a particular relative position corresponding to the code of the key 501.

As illustrated, the key-engaging elements 506, 507 can have a structure similar to a plate tumbler with an aperture positioned to allow the key 501 to pass through it when inserted into the barrel 530. Although a substantially O-shaped tumbler is illustrated, other types and shapes of tumblers 523 are possible. For example, the tumblers 523 can each have an L-shape, C-shape, T-shape, I-shape, and the like. Regardless of the shape of the tumbler, a portion of the key-engaging element 506, 507 contacts the coded surface of the key 501 when the key 501 is inserted into the barrel 530. The key-engaging elements 506, 507 also have a portion that can be engaged by the sidebar-engaging tumbler elements 583. In some embodiments (such as that shown in FIGS. 24 and 25), this portion is serrated, ribbed, embossed, dimpled, or is otherwise shaped to provide a robust fit between the two elements 506, 507 and 583.

The key-engaging element 506, 507 can also have a portion for engaging a spring or other bias member. This portion for engaging a bias member can be located anywhere on the key-engaging elements 506, 507. The bias members (not shown) bias the tumbler elements 506, 507 to locked positions when the key 501 is removed from the keyhole. The key-engaging elements 506, 507 can be biased in substantially opposite directions in a substantially alternating fashion in a conventional manner. However, in some embodiments, the key-engaging elements 506, 507 can be biased in the same direction (also in a conventional manner).

The sidebar-engaging element 583 in the illustrated embodiment of FIGS. 22–25 has a channel 583*a* that engages the sides of the key-engaging element 506, 507 during the coding process. The sidebar-engaging elements 583 can be held in an engaged position with the key-engaging elements 506, 507 by a friction fit, an interference fit, an interlocking fit, a snap fit, and the like. Additionally, although the channel 583*a* engages the sides of the key-engaging element 506, 507 in the exemplary embodiment of FIGS. 22–25, the channel 583*a* can engage any other portion of the key-engaging elements 506, 507. In alternative embodiments, the engaging structure can be reversed such that the channel is located on the key-engaging elements 506, 507 for engagement with any portion of the sidebar-engaging elements 583.

Figures 25A, 25B, 25C:
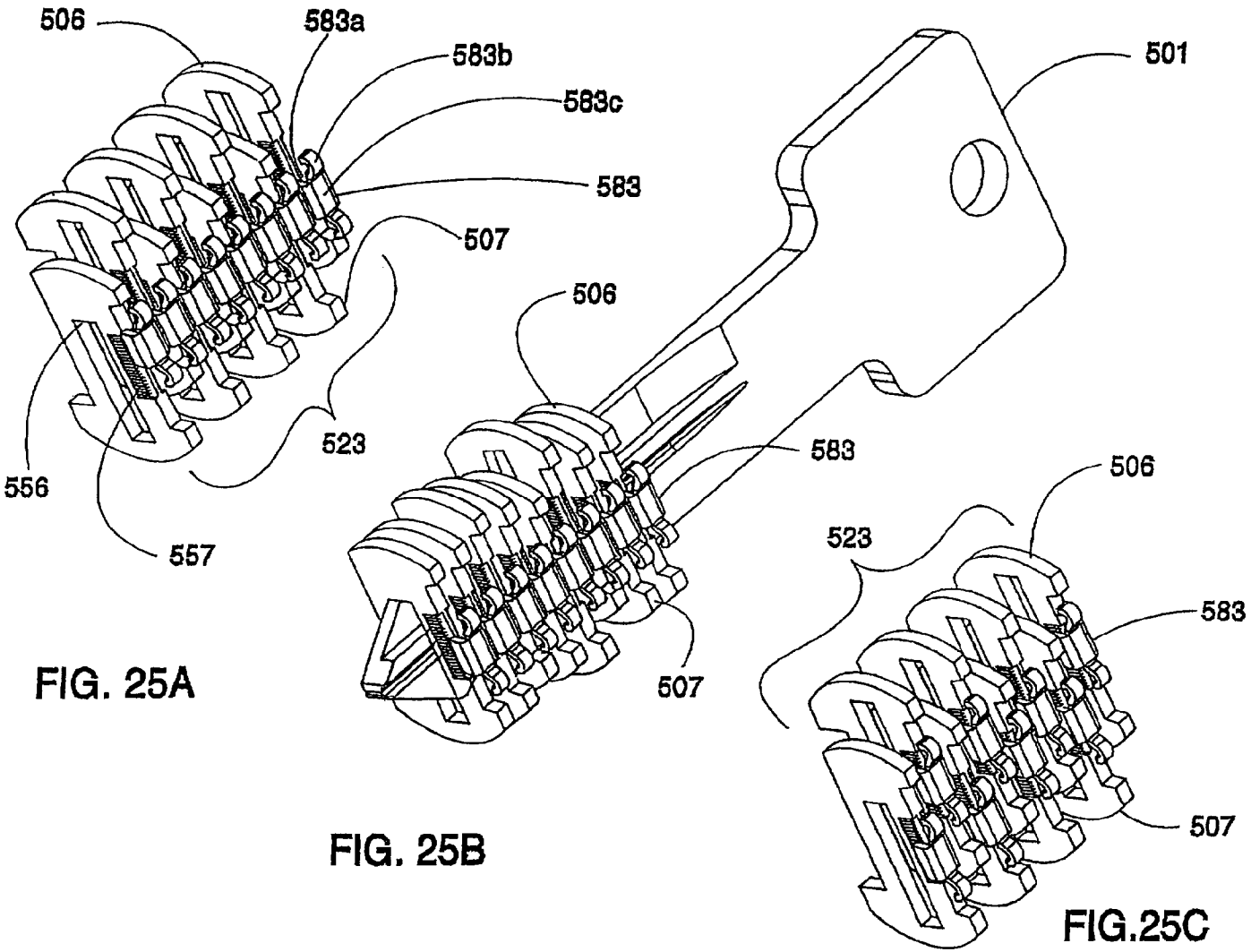
FIG. 25A is a perspective view of the tumblers illustrated in FIG. 23, shown in the uncoded state with the key-engaging elements disengaged from the sidebar-engaging elements.
FIG. 25B is the perspective view of the tumblers illustrated in FIG. 25A, shown with a key inserted, a portion of the tumblers shifted to the code of the key, and the key-engaging elements disengaged from the sidebar-engaging elements.
FIG. 25C is the perspective view of the tumblers illustrated in FIG. 25A, shown with the tumblers coded (i.e., the key-engaging elements engaged from the sidebar-engaging elements) and with the key removed.
Figure 25D:
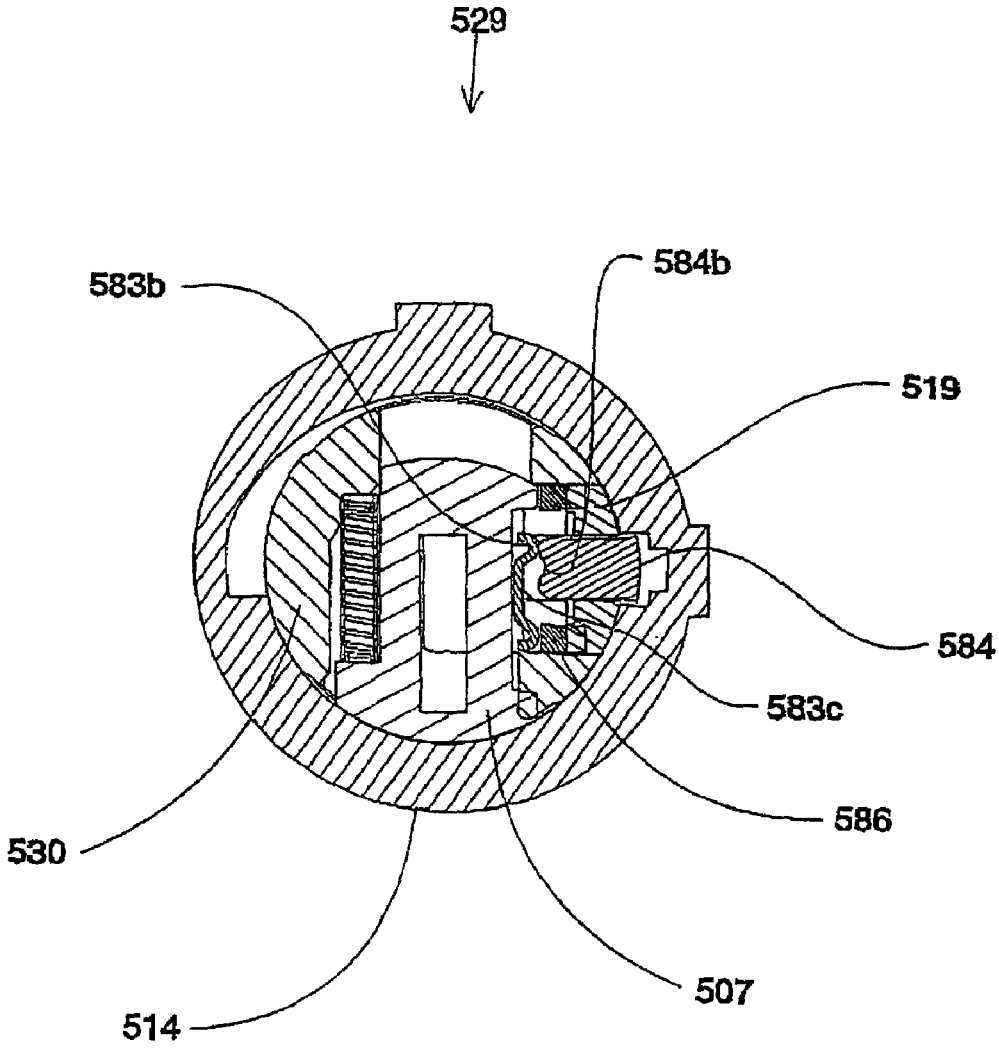
FIG. 25D is a cross-sectional view of the lock illustrated in FIG. 22, showing the relative positions of the various elements with the lock in the coded and locked state.

As shown in FIGS. 25A and 25B, the two tumbler elements 506, 507, 583 are independent of each other prior to coding. However, once coded, the channel 583*a* of the sidebar-engaging elements 583 straddle the side of the key-engaging tumbler elements 506, 507 and are fixed to the key-engaging tumbler elements 506, 507 in the coded state by a friction fit. In some embodiments, this friction fit connection between the two tumbler elements 506, 507, 583 enables exact placement of the tumbler elements 506, 507, 583 with respect to one another, and can reduce or eliminate manufacturing tolerance problems associated with the tumblers 523 and tumbler location in the lock assembly 529. To robustly retain the code defined by the relative positions of the tumbler elements 506, 507, 583 and to provide resistance to tampering or misuse, the mating surfaces of the key-engaging tumbler elements 506, 507 can be serrated while the mating edges of the sidebar-engaging tumbler 583 can have a stamping burr and/or be turned slightly. Thus, the edges of the sidebar-engaging tumbler elements 583 can positively engage the key-engaging elements 506, 507 and can resist any alterations to the code setting.

The coding process of the embodiment illustrated in FIGS. 22–25 will now be described in further detail. Referring to FIGS. 25A–25C, the coding process of the lock assembly 529 begins with the insertion of the key 501. As the key 501 enters the barrel 530, the key-engaging elements 506, 507 shift to an extent determined at least in part by the depth of the coding on the key surface. Once the key 501 is fully inserted, the key-engaging elements 506, 507 can rest against the coded surfaces of the key. As will be described below, a code setting mechanism is then utilized to cause the tumblers elements 506, 507, 583 to engage each other.

The lock assembly 529 illustrated in FIGS. 22–25 is coded to the key 501 by rotating the barrel 530 with respect to the housing 514 in response to turning the key 501. As the barrel 530 is turned, the sidebar-engaging elements 583 are shifted towards the key-engaging elements 506, 507 by camming action of the sidebar 584 against the inside surface of the housing 514 in a manner similar to that described above with regard to the follower 170, 370 in the first and third embodiments. This shift can be caused in a number of other manners, such as by a camming action of the sidebar-engaging elements 583 against an interior surface of the housing 514, by one or more springs directly or indirectly exerting force against the sidebar-engaging elements 583 in at least one rotational position of the barrel 530, and the like. In other embodiments, however, the barrel does not need to rotated to code the lock. Rather, the code setting mechanisms described in any of the embodiments described and illustrated herein can be used. For example, the code setting mechanisms disclosed in FIGS. 1–13 and 19–21 are adaptable to be utilized in the present embodiment.

As illustrated in several embodiments and as mentioned above, the shift of the sidebar-engaging elements 583 can be caused by the sidebar 584 camming against an interior portion of the housing 514, which in turn exerts a force upon the sidebar-engaging elements 583 to move the sidebar-engaging elements 583 into engagement with the key-engaging elements 506, 507. In the uncoded condition, the sidebar 584 extends from the barrel 530 into a recess in the housing 514. The inside surface of the housing 514 is shaped to cause the sidebar 584 to be pushed toward the barrel 530 as the barrel 530 is being rotated with respect to the housing 514 (e.g., such as by a ramped or other cam surface defined in the inside of the housing 514). As discussed in greater detail below, as the sidebar 584 is forced to retract within the barrel 530 by the inside surface of the housing 514, the sidebar 584 forces the sidebar-engaging elements 583 to engage the key-engaging elements 506, 507.

As shown in FIG. 25C, shifting of the sidebar-engaging elements 583 towards the key-engaging elements 506, 507 allows the elements 506, 507, 583 to engage each other via a friction fit. However, other manners of engagement are possible, such as having projection(s) and/or recess(es) on the key-engaging elements 506, 507 engage corresponding recess(es) and/or projection(s) on the sidebar-engaging elements 583. This engagement produces a tumbler combination 523 coded to the particular notch depth of the key 501. Thus, in the coded state, the sidebar-engaging elements 583 and the key-engaging elements 506, 507 are capable of moving together in response to forces exerted on either element.

Once the key 501 is removed, at least one spring or other bias member (not shown) can bias one or more of the tumbler combinations 523 into the locked state. As discussed in greater detail with regard to the embodiment illustrated in FIGS. 19–21, this biasing in turn can cause the sidebar-engaging element 583 to exert a force on the sidebar 584. As such, the sidebar 584 is forced radially into engagement with the housing 514, which prevents rotation of the barrel 530 with respect to the housing 514 in a manner well known in the art. The sidebar 584 and the tumbler combinations 523 can engage in any conventional manner or in the manner discussed above in regard to the embodiment disclosed in FIGS. 19–21. For example, the sidebar 584 and the tumbler combinations 523 can engage in any male-female engagement, such as a projection and recess engagement of the elements 523, 584. In some embodiments such as that shown in the embodiment of FIGS. 22–25, the sidebar-engaging elements 583 have a pair of projections 583*b* that form a recess 583*c* within which the sidebar 584 engages. When the recesses 583*c* formed by the projections 583*b* are aligned with the projection on the sidebar 584, the sidebar 584 is biased into engagement with the recesses 583*c*. This movement of the sidebar 584 causes the sidebar 584 to retract within the barrel 530 and disengage the housing 514.

In other embodiments, the sidebar 584 does not have a projection. Rather, the projections 583*c* on the sidebar-engaging tumbler elements 583 are configured to rest on either side of the sidebar 584 in the unlocked condition. Therefore, the recesses 583*c* on the sidebar-engaging tumbler elements can align with the sidebar 584 once the properly coded key is inserted. When the recesses 583*c* on the sidebar-engaging tumbler elements 583 align with the sidebar 584, the projections 583*b* of the sidebar-engaging tumbler elements 583 are positioned on either side of the sidebar 584. As such, the sidebar 584 is able to be biased towards the recess 583*c* of the sidebar-engaging tumbler element 583. Thus, the sidebar 584 retracts from engagement with the housing 514 to allow rotation of the barrel 530 with respect to the housing 514.

Other embodiments also utilize a sidebar 584 with an anti-pick feature 584*b*. The exemplary anti-pick feature illustrated in FIGS. 22–24 utilizes a recess 584*b* on the sidebar 584 rather than a projection to engage the tumbler combinations 523. This recess 584*b* can work as an anti-pick feature due to the configuration of the sidebar-engaging tumbler elements 583. The projections 583*b* on the sidebar-engaging tumbler elements 583 can align with and engage the recess 584*b* on the sidebar 584 when one is attempting to pick the lock. When this occurs, the person attempting to pick the lock may assume that the tumbler combination 523 is properly aligned with the sidebar 584 due to the engagement of the projection 583*c* with the recess 584*b*. However, the sidebar-engaging tumbler elements 583 are instead improperly aligned with the sidebar 584 to enable the sidebar 584 to retract from the housing 514 as described above. Thus, the sidebar 584 will not disengage from the housing 514.

Figure 24:
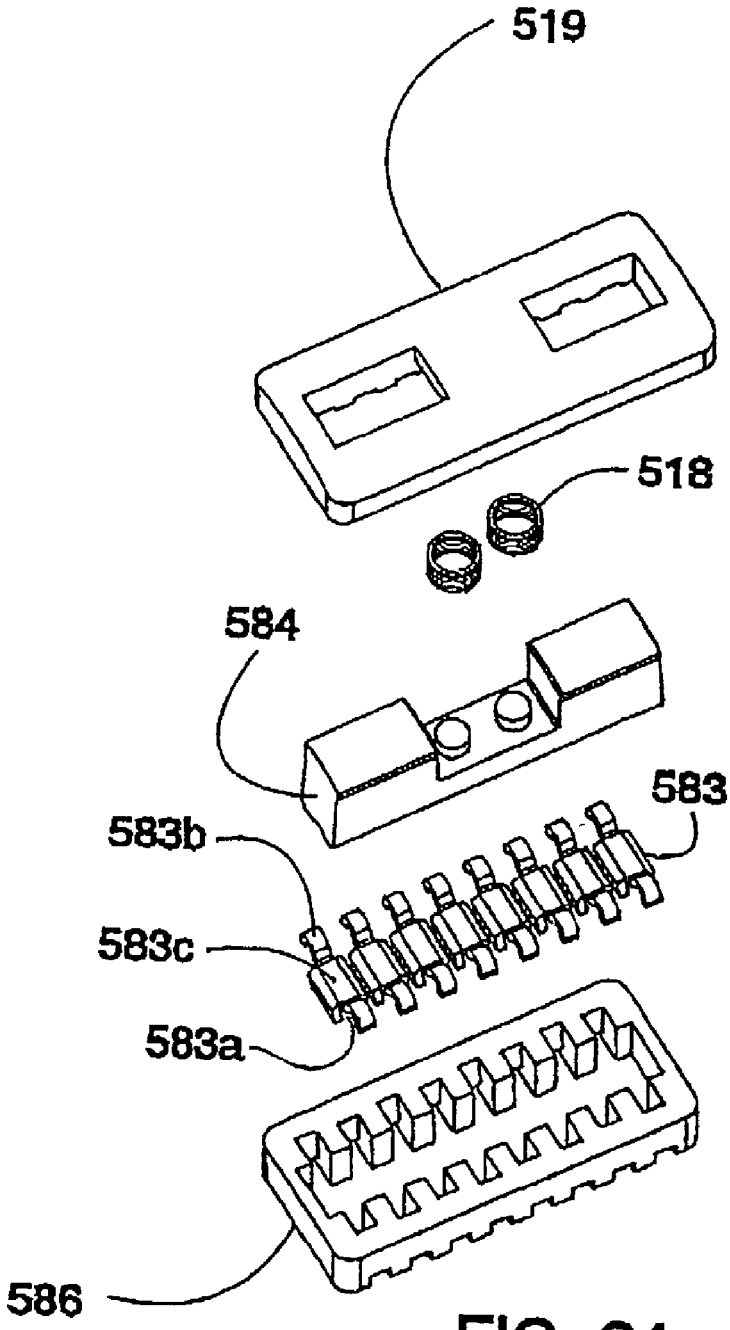
FIG. 24 is an exploded perspective view of the sidebar cartridge shown in FIG. 23.

In some embodiments, the sidebar-engaging elements 583 can be contained within a carrier 586 as illustrated in FIG. 24 prior to coding. The sidebar-engaging tumbler elements 583 can be contained within an apertured wall of the carrier 586 prior to coding. In some embodiments, the sidebar-engaging tumbler elements 583 are held within the apertured wall via a friction fit prior to coding. However, in other embodiments, the sidebar-engaging tumbler elements 583 merely rest against the apertured wall prior to coding. In either embodiment, an interference fit or frictional engagement can keep the sidebar-engaging elements contained in desired positions within the carrier 586 until the lock is coded. In still other embodiments, the sidebar-engaging tumbler elements 583 are retained in place in the carrier 586 by one or more bosses, lugs, recesses, walls, pins, fingers, or other elements on or defined by the carrier 586 for registration of the sidebar-engaging tumbler elements 583. Regardless of how the sidebar-engaging tumbler elements 583 are retained within the carrier 586, each of the sidebar-engaging tumbler elements 583 can be held in position substantially aligned with a key engaging tumbler element 506, 507 (in a manner permitting the sidebar 584 to retract from the housing 514). Such an arrangement can result in a lock assembly in which less motion is necessary to code the lock.

Figure 23:
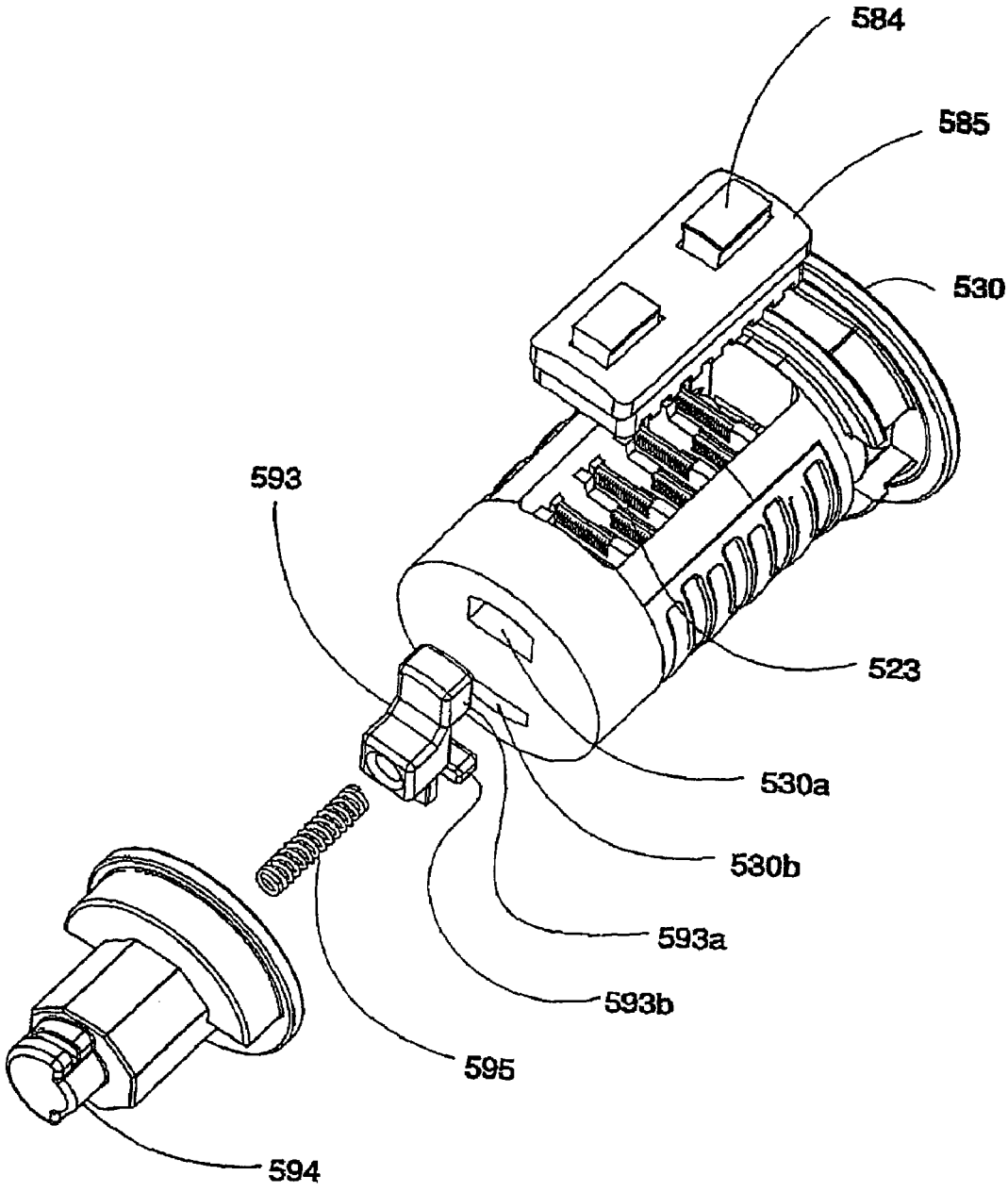
FIG. 23 is a rear end partially exploded perspective of the codeable tumbler lock barrel assembly illustrated in FIG. 22, shown without the housing and with the sidebar cartridge removed.

As shown in the illustrated embodiment, the carrier 586 can be part of a larger subassembly containing the sidebar, such as a sidebar cartridge 585 as shown in FIGS. 23 and 24. The sidebar cartridge 585 can facilitate easier assembly of the lock assembly 529. The sidebar cartridge 585 can be comprised of the carrier 586, the sidebar-engaging elements 583, and the sidebar 584, and in some cases can further include a sidebar spring or other bias member 518 and/or a cover 519. As assembled, the sidebar-engaging elements 583 can rest in or be aligned with apertures of the carrier 586 or can otherwise be retained in the carrier 586 as described above. Additionally, the sidebar 584 can rest against or adjacent to the sidebar-engaging elements 583. In some embodiments where the sidebar-engaging tumbler elements 583 are retained in apertures in the carrier 586, the sidebar 584 can have a portion that engages and forces the sidebar-engaging tumbler elements 583 through the carrier wall during the coding process. If employed, the sidebar bias member(s) 518 can rest against the sidebar 584 and can be held in place by the cover 519.

In other embodiments, much of the structure described in the previous paragraph can be eliminated. For example, the sidebar-engaging elements 583 can be releasably seated upon or connected to the sidebar 584 (or another element adjacent to the sidebar) and can be transferred to the tumblers 506, 507 by frictional engagement therewith as described above (thereby avoiding the need for the carrier 586). Alternatively, the sidebar 584 can be eliminated in its entirety. In such an embodiment, the sidebar-engaging tumbler elements 583 can be forced into engagement in any manner discussed in other embodiments of the present invention. Specifically, a code setting mechanism such as that described with regard to the embodiments disclosed in FIGS. 1–21 can be used.

In those embodiments employing a sidebar cartridge 585, the sidebar cartridge 585 can be installed adjacent the barrel 530 and key-engaging tumbler elements 506, 507 after assembly of the sidebar cartridge 585, or can alternatively be assembled in the lock assembly 529. Also, in those embodiments in which rotation of the barrel 530 causes the sidebar 584 to be forced toward the barrel 530 by the inside surface of the housing 514 (as described above), the sidebar 584 may extend a greater distance from the cover 519 of the cartridge 585 in the uncoded state than in the locked and coded state. This greater extension is due to the position of the sidebar-engaging elements 583 in the uncoded state. In the uncoded state, the sidebar engagement elements 583 are retained within the cartridge 585, while in the coded state they are mated to the key-engaging elements 506, 507. While retained with the cartridge 585, the sidebar engagement elements 583 can take up space within the cartridge 585, which forces the sidebar 584 to extend a greater distance from the cover 519 than in the coded state. During the coding process, the sidebar 584 forces the sidebar-engaging elements 583 through the carrier wall of the cartridge 585 to mate with the key-engaging elements 506, 507. This creates more room in the cartridge 585 for the sidebar 584. Thus, the sidebar 584 does not extend as far from the cartridge 585 in the coded condition. In some embodiments, the sidebar 584 extends about one millimeter less in the coded and locked state than in the uncoded state.

Yet another embodiment of a codeable lock according to the present invention is illustrated in FIGS. 26–32, and is similar in many respects to the previous embodiment. For example, both embodiments have similar housings, barrels, and sidebars. A substantial difference between the embodiment illustrated in FIGS. 26–32 and that illustrated in FIGS. 22–25 is the manner in which engagement is established between the key-engaging tumbler elements and the sidebar-engaging tumbler elements. With the exception of the structure and features described below, additional information regarding the lock assembly illustrated in FIGS. 26–32 can be found in the previously-described embodiments of the present invention.

Like the illustrated embodiment of FIGS. 22–25 described above, the embodiment of the present invention illustrated in FIGS. 26–32 has a housing 614, a barrel 630, and one or more tumblers 623 within the barrel 630. Each tumbler 623 can be defined by two or more elements movable with respect to one another for purposes of coding. In this illustrated embodiment for example, each codeable tumbler combination 623 can include a key-engaging element 606, 607 and a sidebar-engaging element 683. In the uncoded state, the key-engaging tumblers elements 606, 607 are movable independent of the sidebar-engaging elements 683. In the coded state, these elements 606, 607, 683 are coupled to each other in a position relative to the code of the key.

Figures 26, 27, 28, 29, 30, 31A, 31B, 32:
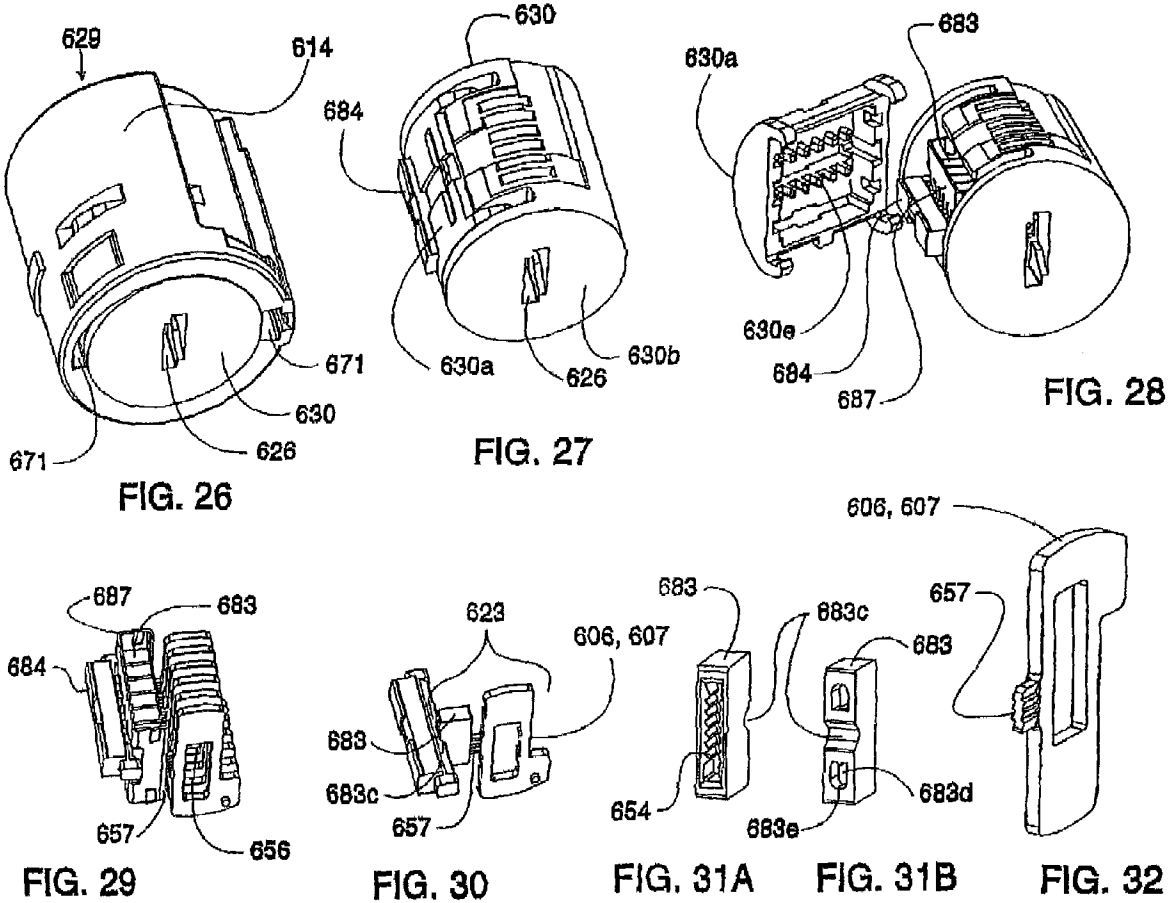
FIG. 26 is a front perspective view of a codeable tumbler lock assembly according to a seventh embodiment of the present invention.
FIG. 27 is a front perspective view of the barrel illustrated in FIG. 26, shown removed from the housing and with the sidebar extended.
FIG. 28 is a partial front perspective view of the barrel illustrated in FIG. 27, shown with a portion of the barrel removed to show the sidebar and the sidebar-engaging tumbler elements.
FIG. 29 is a front perspective view of tumblers and the sidebar illustrated in FIG. 28, shown removed from the barrel.
FIG. 30 is a front perspective view similar to FIG. 29, showing several tumblers removed.
FIG. 31A is a perspective view of the sidebar-engaging tumbler element shown in FIGS. 27 and 28, showing the serrated aperture of the sidebar-engaging element.
FIG. 31B is a perspective view of the sidebar-engaging tumbler element illustrated in FIG. 31A showing the reverse side.
FIG. 32 is a perspective view of the key-engaging tumbler element shown in FIG. 29.

Much like the previous embodiment, the key-engaging tumbler elements 606, 607 can have an illustrated structure similar to a plate tumbler with an aperture positioned to allow a key to pass therethrough when inserted into the barrel 630. Although a substantially O-shaped tumbler 623 is illustrated in FIGS. 29, 30, and 32, other types and shapes of tumblers 623 are possible. For example, the tumbler 623 can have an L-shape, C-shape, T-shape, I-shape, and the like. Regardless of the shape of the tumbler 623, in some embodiments a portion of the key-engaging element 606, 607 is able to contact the coded surface of the key when inserted into the barrel 630.

The key-engaging element 606, 607 can also have a portion for engaging a spring or other bias member. This portion for engaging a bias member can be located anywhere on the element 606, 607. The bias members (not shown) bias the tumbler elements 606, 607 to locked positions when the key is removed from the keyhole. The key-engaging elements 606, 607 can be biased in substantially opposite directions in a substantially alternating fashion. However, in other embodiments, the key-engaging elements 606, 607 are biased in the same direction.

As illustrated, the key-engaging elements 606, 607 and the sidebar-engaging elements 683 can engage each other with a coupling. This coupling can take a variety of forms, such as a force fit, a friction fit, an interference fit, a snap fit, a mating fit, and the like. For example, the key-engaging elements 606, 607 can have one or more projections and/or recesses 657 to engage the sidebar-engaging elements 683. Similarly, the sidebar-engaging tumbler elements 683 can have at least one surface with one or more projections and/or recesses 654 to engage the key-engaging elements 606, 607 during the coding process.

With reference to the exemplary embodiment illustrated in FIGS. 26–32, the key-engaging tumbler elements 606, 607 have at least one projection 657 that engages an aperture 654 of the sidebar-engaging tumbler element. As shown in FIGS. 31 and 32, the projection 657 can have a serrated or notched periphery, while the sidebar-engaging element can have a matching profile along the interior of the aperture 654. Furthermore, the aperture 654 is longer than the projection, 657 to allow for many potential engagement positions with the key-engaging element 683 during the coding process. Once the projection 657 is inserted into the aperture 654, the serrations align and interlock to prevent relative motion between the two pieces in the directions that the tumblers are biased.

Although a serrated projection 657 and recess 654 are employed to join the key and sidebar-engaging tumbler elements 683, 606 and 607 illustrated in FIGS. 26–32, the projection 657 and recess 654 (if used) do not need to be serrated. For example, some embodiments of the present invention utilize a simple projection and recess engagement that is not serrated, while other embodiments utilize one or more projections and recesses that have other mating shapes. A non-limiting list of such mating periphery shapes can include circular, square, triangular, polygonal, and the like. Additionally, some other embodiments can utilize multiple projections and/or recesses by which the tumbler elements 606, 607, 683 can be releasably engaged in two or more relative positions.

Since the sidebar-engaging tumbler elements 683 are not engaged with the key-engaging tumbler elements 606, 607 in the uncoded state, the lock assembly illustrated in FIGS. 26–32 can employ a number of different elements and features to control the location and orientation of the sidebar-engaging tumbler elements 683 prior to and during the coding process. By way of example only, (and as will be described in greater detail below), one of the features provided in the illustrated embodiment controls the location and orientation of the sidebar-engaging tumbler elements 683 in the uncoded condition, while another feature controls the location and orientation of the sidebar-engaging tumbler elements 683 during the coding process. Although two separate features are used in the illustrated embodiment, they can be combined in various other embodiments.

Each sidebar-engaging tumbler element 683 can have one or more apertures 683*d* adjacent the barrel 630 as shown in FIG. 31B. These apertures can engage one or more projections 630*e* on the barrel 630 (see barrel portion 630*a* in FIG. 28) or another feature of the lock in the uncoded condition to control the location and orientation of the sidebar-engaging element prior to coding. For example, in the illustrated embodiment of FIGS. 26–32, the apertures 683*d* engage projections 630*e* on the barrel 630, 630*a*. The sidebar-engaging tumbler elements 683 can be held in positions engaged with the projections 630*e* via a friction fit, a force fit, an interference fit, adhesive, a bias member, and the like. Also, in some embodiments one or more ribs 683*e* (or other projections) can extend from the interior wall of the aperture 683*d* to enhance or cause a friction fit with the projection 630*e* on the barrel 630, 630*a*. One way of engaging the sidebar-engaging tumbler elements 683 with the barrel 630, 630*a* is to assemble the lock with the apertures 683*d* engaged with the projections 630*e* on the barrel 630, 630*a*. However, various triggering mechanisms discussed herein can instead be utilized to generate engagement after the lock has been fully or partially assembled. This engagement of the sidebar-engaging tumbler elements with the barrel 630, 630*a* (via the apertures 683*d*) can hold the sidebar-engaging tumbler elements 683 in an aligned position with the key-engaging tumbler elements 606, 607 to facilitate quicker and easier coding. It will be appreciated that the projections 630*e* of the barrel 630, 630*a* and the apertures 683*d* in the sidebar-engaging tumbler elements 683 can be reversed in location, and can also be replaced by a number of alternative structures and elements providing releasable engagement and retention of the sidebar-engaging tumbler elements 683 with respect to the barrel 630, 630*a*.

After the coding process has begun, the sidebar-engaging tumbler elements 683 in the exemplary illustrated embodiment of FIGS. 26–32 are drawn away from the barrel 630, 630*a*. This causes disengagement between the apertures 683*d* on the sidebar-engaging elements 683 and the projections 630*e* on the barrel 630, 630*a*. To maintain the orientation of the sidebar-engaging elements 683 in this period of transition between the uncoded state and the coded state, a push plate 687 can be utilized. Among other attributes, the push plate 687 prevents the sidebar-engaging elements 683 from translating or substantially pivoting while moving toward the key-engaging tumbler elements 623. Thus, the push plate 687 helps to facilitate a quick, clean engagement between elements 606, 607, 683. As illustrated, the push plate 687 has a generally open frame structure, although any structure performing the same function just described can instead be employed. The frame controls the position and orientation of the sidebar engaging tumbler elements 683 during the coding process, while the opening in the frame allows the sidebar 684 to engage and interact with the sidebar-engaging elements 683 both during the coding process and afterwards.

The coding process of the exemplary embodiment illustrated in FIGS. 26–32 will now be described. In this embodiment, the coding process of the lock assembly 629 begins with the insertion of the key 601. As the key 601 enters the barrel 630, the key-engaging elements 606, 607 may move to an extent determined at least in part by the depth of the coding on the key surface. When the key 601 is fully inserted, the key-engaging elements 606, 607 can rest against the coded surfaces of the key. A code setting mechanism can then be used to couple the key-engaging tumbler elements 606, 607 to the sidebar engaging tumbler elements 683, such as any of the structures described elsewhere herein for moving sidebar-engaging tumbler elements with respect to key-engaging tumbler elements.

The lock assembly 629 illustrated in FIGS. 26–32 is coded to the key 601 by rotating the barrel 630 with respect to the housing 614 in response to turning the key 601. As the barrel 630 is turned, the sidebar-engaging elements 683 are shifted towards the key-engaging elements 606, 607. As indicated above, this shift can be caused in a number of different manners, such as by a camming action of the sidebar-engaging elements 683 against an interior surface of the housing 614, by one or more springs directly or indirectly exerting force against the sidebar-engaging elements 683 in at least one rotational position of the barrel 630, and the like. In other embodiments, however, the barrel does not need to rotated to code the lock. Rather, the non-rotating code setting mechanisms described above can instead be used as desired. For example, the code setting mechanisms disclosed with reference to the embodiments of FIGS. 1–13 and 19–21 are adaptable to be utilized in the present embodiment.

As illustrated in several embodiments, the above-described shift of the sidebar-engaging elements 683 can be caused by the sidebar 684 camming against an interior portion of the housing 614, which in turn exerts a force upon the sidebar-engaging elements 683 to move the sidebar-engaging elements 683 into engagement with the key-engaging elements 606, 607. In the uncoded condition, the sidebar 684 extends from the barrel 630 into a recess in the housing. The inside surface of the housing 614 can be shaped to cause the sidebar 684 to be pushed toward the barrel 630 as the barrel 630 is being rotated with respect to the housing 614 (e.g., such as by a ramped or other cam surface defined in the inside of the housing 614). As discussed in greater detail below, as the sidebar 684 is forced to retract within the barrel 630 by the inside surface of the housing 614, the sidebar 684 forces the sidebar-engaging elements 683 to engage the key-engaging elements 606, 607.

As illustrated, shifting of the sidebar-engaging elements 683 towards the key-engaging elements 606, 607 allows the projections of the key-engaging tumbler elements 606, 607 to engage the sidebar-engaging tumbler elements 683. In some embodiments, the elements 606, 607, 683 are held together with a friction and/or mating fit between the two elements as discussed above. However, other manners of engagement are possible, such as any type of male-female fit. This engagement produces a tumbler combination 623 coded to the particular notch depth of the key 601. Thus, in the coded state, the sidebar-engaging elements 683 and the key-engaging elements 606, 607 are able to move together in response to forces exerted on either element.

Once the key 601 is removed, at least one spring (not shown) can move one or more of the tumblers 623 into the locked state. As discussed above, moving the tumblers 623 in this manner causes the sidebar 684 to be cammed into engagement with the housing 614 to thereby prevent rotation of the barrel 630 with respect to the housing 614. The sidebar 684 and the tumbler combinations 623 can engage in any conventional manner or in the manner discussed above in regard to the embodiment of the present invention disclosed in FIGS. 19–21. For example, the sidebar 684 and the tumbler combinations 623 can engage in any male-female engagement, such as a projection and recess engagement of the elements 623, 684. As illustrated in FIG. 31A and 31B, the sidebar-engaging elements 683 have a recess 683*c* within which can be received a projection of the sidebar 684. When the recesses 683*c* are aligned with the projection on the sidebar 684, the sidebar 684 is biased into engagement with the recess 683*c* (such as by one or more springs or other biasing elements, not shown). This movement of the sidebar 684 causes the sidebar 684 to retract within the barrel 630 and to disengage the housing 614.

When a correctly coded key is removed from the lock illustrated in FIGS. 26–32, the spring-biased tumbler combinations 623 are forced by springs (positioned in a conventional manner to bias the tumbler combinations 623) into their locked positions. By virtue of the shape of the recess 683*c* and mating sidebar projection 683*c*, this movement of the tumbler combinations 623 forces the sidebar 684 radially outward to engage the sidebar 684 with the housing 614, thereby preventing rotation of the barrel 630 with respect to the housing 614 (and locking the lock).

As mentioned above, the locks of the present invention generally interact with another device or other components, including but not limited to a latch or various ignition components. Since these devices may not have a range of motion comparable to that of the lock as it is coded, these devices may need to be initially isolated from the motion of the lock during the coding process. For example, certain automobile door locks only have a rotational range of motion between plus or minus forty-five degrees. In other words, the door latch has a limited range of motion that cannot be exceeded. Since in some embodiments of the present invention the barrel can be rotated during the coding process through a greater range of motion than a device (e.g., a latch) connected thereto, it may be necessary to isolate the device from the lock during at least part of the coding process. Therefore, some embodiments of the lock according to the present invention are equipped with a clutch or other motion isolation element to prevent rotation of the lock from transferring to the connected device for a range of motion during the coding process. Thus, in these embodiments, as the coding process begins, the barrel is rotated but the lock output mechanism (e.g., a lever connected to the device) does not rotate. As the coding process continues, the clutch member (or other isolation element) drivingly engages the barrel and thereafter causes motion and force to be transferred to the lock output mechanism. Accordingly, further rotation of the barrel generates motion of the latch or other device.

Figure 22:
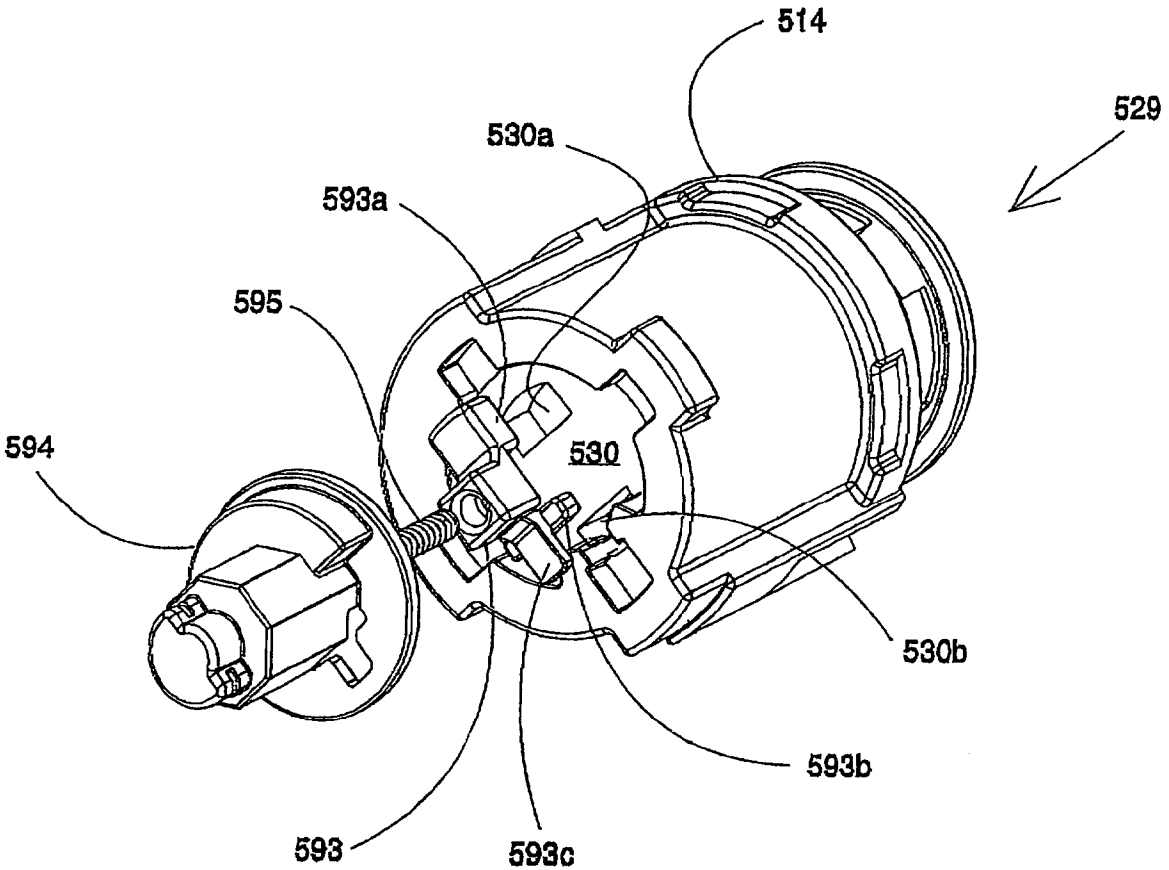
FIG. 22 is a rear end partially exploded perspective view of a codeable tumbler lock assembly according to a sixth embodiment of the present invention with a clutch between the lock assembly and the output mechanism.

An example of an isolation element and a lock output mechanism is illustrated in FIGS. 22 and 23. In this embodiment, a spring loaded clutch 593 is located between the barrel 530 and the output mechanism 594, and has two projections 593*a*, 593*b* that engages two recesses 530*a*, 530*b* respectively on the barrel 530 as the barrel 530 is rotated with respect to the clutch member 593. The projection 593*a* is similarly shaped to recess 530*a*, but has a different shape than recess 593*b*. Also, the projection 593*b* is similarly shaped to recess 530*b*, but has a different shape than recess 593*a*. Therefore, the clutch 593 only engage the barrel 530 when these elements are correctly aligned.

The projections 593*a*, 593*b* of the clutch member 593 are initially not aligned with the recesses 530*a*, 530*b* on the barrel 530, thereby allowing the barrel 530 to rotate without transferring motion to the output mechanism 594. Due to the shape of these elements, they can be out of alignment by 180 degrees or more. However, after a predetermined amount of barrel 530 rotation, the recesses 530*a*, 530*b* on the barrel 530 align with the projections 593*a*, 593*b* on the clutch 593. The spring 595 biases the clutch 593 into engagement with the barrel 530. After the clutch 593 engages the barrel 530, further movement of the barrel 530 is transferred to the output mechanism 594.

Also, as illustrated in FIGS. 22 and 23, the clutch member 593 can also have a tail member 593*c* capable of engaging the housing 514 in the uncoded condition. Without this tail 593*c*, the clutch 593 may be able to rotate with the barrel 530 in the uncoded state due to frictional engagement between the clutch 593 and the barrel 530. Since the tail 593*c* engages the housing 514 in the uncoded state and the housing 514 does not rotate, the clutch 593 does not rotate with the barrel 530. The clutch 593, however, does rotate with the barrel 530 once the projections 593*a*, 593*b* and recesses 530*a*, 530*b* on the two elements engage.

It will be appreciated that the recesses 530*a*, 530*b* on the barrel 530 and the projections 593*a*, 593*b* on the clutch member 593 can be reversed, or can be replaced by any other clutch mechanism well-known in the art, or any other inter-engaging structure or elements that engage to drive the output mechanism after a desired amount of rotation of the barrel 530. Furthermore, the number and shape of the engaging elements can vary. For example, the barrel 530 can be provided with a clutch engagement element or projection and the output mechanism (or other intermediate element) can be provided with a clutch plate or recess. In other embodiments, such clutch mechanisms, structures, and elements include without limitation pins or dogs on the clutch or barrel rotatable into recesses or apertures in the barrel or clutch, respectively, inter-engaging teeth on the clutch and barrel, and the like. Such alternative clutch mechanisms, structures, and elements fall within the spirit and scope of the present invention.

Figures 33, 34A, 34B, 34C:
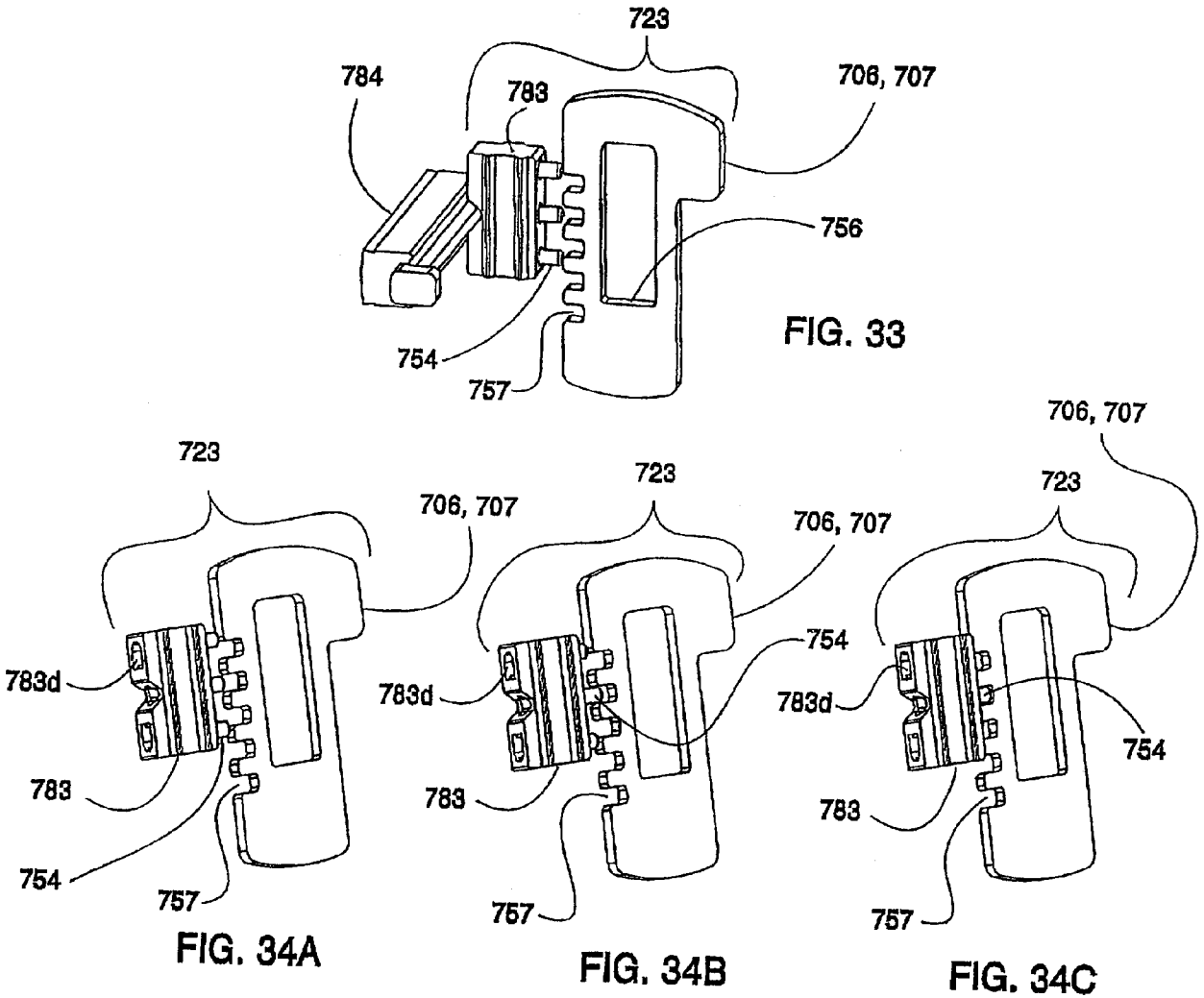
FIG. 33 is a perspective view of the sidebar and a tumbler removed from the barrel of the codeable tumbler lock assembly according to the eighth embodiment of the present invention.
FIG. 34A is a perspective view of the tumbler illustrated in FIG. 33, shown with the tumbler in an uncoded position.
FIG. 34B is the perspective view of the tumbler illustrated in FIG. 34A, shown with the tumbler in a position during the coding process and with the projections of the tumbler aligned with recesses of the tumbler.
FIG. 34C is the perspective view of the tumbler illustrated in FIG. 34A, shown with the tumbler in the coded position.

Yet another embodiment of a codeable lock according to the present invention is illustrated in FIGS. 33–34. This embodiment is similar to the previous embodiment in many respects. For example, the embodiment illustrated in FIGS. 33–34 is similar to the embodiment illustrated in FIGS. 26–32 in that both embodiments can employ similar housings, barrels, and sidebars. Accordingly, with the exception of the structure and features described below, additional information regarding the lock assembly illustrated in FIGS. 33–34 can be found in the previously-described embodiment of the present invention.

Like the previous illustrated embodiment described above, the tumbler combinations 723 in the embodiment of the present invention illustrated in FIGS. 22–24 is employed in a housing and barrel similar to the housing 614 and barrel 630 illustrated in FIGS. 26–28. Each tumbler 723 can be defined by two or more elements movable with respect to one another for purposes of coding. In the illustrated embodiment of FIGS. 33–34 for example, each codeable tumbler combination 723 includes a key-engaging element 706, 707 and a sidebar-engaging element 783. In the uncoded state, the key-engaging tumblers elements 706, 707 are independent of the sidebar-engaging elements 783. In the coded state, these elements 706, 707, 783 are coupled to each other in a position relative to the code of the key.

Much like the embodiment of the present invention illustrated in FIGS. 26–32, the key-engaging tumbler elements 706, 707 have an illustrated structure similar to a plate tumbler with an aperture positioned to allow the key to pass through it when inserted into the barrel 730. Although a substantially O-shaped tumbler is illustrated, other types and shapes of tumblers are possible. For example, the tumbler can have an L-shape, C-shape, T-shape, I-shape, and the like. Regardless of the shape of the tumbler, a portion of the key-engaging element 706, 707 should be able to contact the coded surface of the key 701 when the key is inserted into the barrel (not shown in FIGS. 33–34).

The key-engaging tumbler element 706, 707 can also have a portion for engaging a spring or other bias member in a conventional manner. This portion for engaging a spring or bias member can be located anywhere on the element 706, 707 (such as on a ledge or projection as illustrated in FIGS. 33 and 34. The bias members (not shown) bias the tumbler elements 706, 707 to locked positions when the key is removed from the keyhole.

The key-engaging tumbler elements 706, 707 of the embodiment illustrated in FIGS. 33–34 engage a second tumbler element 783 in the coded condition. The key-engaging elements 706, 707 can each have at least one key-engaging surface 756 and one or more projections and/or recesses 757 to engage the sidebar-engaging elements 783. As shown in FIGS. 34A–34C by way of example only, the key-engaging tumbler elements 706, 707 have apertures 757, such as indentations, recesses, notches, grooves and the like, that engage one or more projections from the sidebar-engaging tumbler elements 783. In some embodiments, each key-engaging tumbler element 706, 707 has multiple apertures 757 as shown in FIGS. 33 and 34. These apertures 757 can have any arrangement or spacing as desired. However, in some embodiments, the apertures 757 that are substantially equidistant from each other. Although the illustrated embodiment shows the key-engaging elements 706, 707 having apertures 757 for engagement with projections 754 on the sidebar-engaging elements 783 (as will be described in greater detail below), this engagement structure can instead be reversed to perform the same functions.

As stated above, the lock assembly 729 illustrated in FIGS. 33–34 also has sidebar-engaging tumbler elements 783. As shown in FIG. 33, the sidebar-engaging tumbler elements 783 have a portion that engages the sidebar 784 and a portion that selectively engages the key-engaging tumbler elements 706, 707. In some embodiments, the projections of the sidebar-engaging tumbler elements 783 take the form of pins 754 capable of engaging one or more of the apertures 757 of the key-engaging tumbler elements 706, 707. The pins 754 can have any shape desired, and in the illustrated embodiment have a substantially round cross-sectional shape. In some cases, the pins 754 are retractable. Although the pins 754 can be arranged in any manner on the sidebar-engaging tumbler elements 783, the pins 754 in some embodiments are spaced non-equidistantly, and/or do not have the same spacing as the apertures 757 on the key-engaging tumbler elements 706, 707. Such pin spacing can allow for more potential coding positions for each tumbler 723 as well as more robust pins 754.

In some embodiments, and as will be described in greater detail below, only one of the pins 754 engage a corresponding aperture 757 in the key-engaging element 706, 707 during the coding process, while the other pins 754 are pushed by the key-engaging elements 706, 707 into the body of the sidebar-engaging tumbler element 783. In other embodiments, two or more of the pins (or other projections 754) engage a corresponding aperture 757 in the key-engaging element 706, 707.

The coding process of the embodiment illustrated in FIGS. 33–34 will now be briefly described. In this embodiment, the coding process of the lock assembly 729 begins with the insertion of the key (not shown). As the key enters the barrel (in the same manner as that described and illustrated with reference to the previous embodiment), the key-engaging elements 706, 707 can shift to an extent determined at least in part by the depth of the coding on the key surface. When the key is fully inserted, the key-engaging elements 706, 707 can rest against the coded surfaces of the key.

The lock assembly is coded to the key by rotating the barrel with respect to the housing in response to turning the key. As the barrel is turned, the sidebar-engaging elements 783 are shifted towards the key-engaging elements 706, 707. This shift can be caused in a number of different manners, such as by a camming action of the sidebar-engaging elements 783 against an interior surface of the housing, by one or more springs directly or indirectly exerting force against the sidebar-engaging elements 783 in at least one rotational position of the barrel, and the like. In other embodiments, however, the barrel does not need to be rotated to code the lock. Rather, the alternative code setting mechanisms described in any of the other embodiments described herein can instead be used. For example, the code setting mechanisms described with reference to FIGS. 1–13 and 19–21 can be adapted to be utilized in the present embodiment.

In some embodiments, the above-described shift of the sidebar-engaging elements 783 is caused by the sidebar 784 camming against an interior portion of the housing, which in turn exerts a force upon the sidebar-engaging elements 783 to move the sidebar-engaging elements 783 into engagement with the key-engaging elements 706, 707. In the uncoded condition, the sidebar 784 extends from the barrel into a recess in the housing. As in the embodiment illustrated in FIGS. 26–32, the inside surface of the housing is shaped to cause the sidebar 784 to be pushed toward the barrel as the barrel is rotated with respect to the housing (e.g., such as by a ramped or other cam surface defined in the inside of the housing). As discussed in greater detail below, as the sidebar 784 is forced to retract within the barrel by the inside surface of the housing, the sidebar 784 forces the sidebar-engaging elements 783 to engage the key-engaging elements 706, 707.

As illustrated, shifting of the sidebar-engaging elements 783 towards the key-engaging elements 706, 707 allows the pins 754 of the sidebar-engaging tumbler element 783 to approach and engage the key-engaging tumbler elements 706, 707. As shown in FIG. 34C, one of the pins 754 of each sidebar-engaging element 783 is aligned with an aperture 757 in a corresponding key-engaging element 706, 707 as the sidebar-engaging elements 783 approach the key-engaging elements 706, 707. However, more than one pin and aperture engagement per tumbler 723 is possible in other embodiments. Therefore, as the two tumbler elements engage each other, only the pin(s) 754 aligned with the aperture(s) 757 will remain extended, while the other pins 754, which are misaligned with the remaining apertures 757, will be forced to retract into the sidebar-engaging element 783. Thus, the sidebar-engaging elements 783 and the key-engaging elements 706, 707 can be held together with a friction fit between engaged pins 754 and apertures 757. However, other manners of engagement are possible, such as any other type of male-female fit. By way of example only, some other embodiments utilize the reaction force of a spring-loaded sidebar 784 to hold the pins 754 in the engaged position. Engagement between the tumbler portions 783, 706, 707 produces a tumbler combination 723 coded to the particular notch depth of the key. Thus, in the coded state, the sidebar-engaging elements 783 and the key-engaging elements 706, 707 can move together in response to forces exerted on either element.

Once the key is removed, at least one spring (not shown) can bias one or more of the tumblers 723 into the locked state. As discussed above with reference to the embodiment of the present invention illustrated in FIGS. 26–32, this biasing in turn causes the sidebar 784 to be cammed radially into engagement with the housing to thereby prevent rotation of the barrel with respect to the housing. The action of the sidebar 784 as illustrated is similar in nature to the sidebar action described in the previous embodiments. Therefore, any of the sidebar structures described above can be employed to generate sidebar 784 disengagement from the tumblers 723 upon key removal.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the features and elements of the lock assemblies 29, 129, 229, 329, 429, 529, 629, 729 are described with reference to each lock assembly 29, 129, 229, 329, 429, 529, 629, 729. With the exception of features, elements, and manners of operation that are mutually exclusive of or are inconsistent each illustrated embodiment described above, it should be noted that the alternative features, elements, and manners of operation described with reference to each of the lock assemblies 29, 129, 229, 329, 429, 529, 629, 729 are applicable to the other embodiments. Many variations of certain structural features have been disclosed throughout the embodiments discussed above. Merely because certain variations were not disclosed with respect to one or more embodiments does not mean that those variations are not applicable to those embodiments. For example, any of the code setting mechanisms can be altered to work with each embodiment disclosed. As another example, the anti-pick mechanism disclosed with regard to the sidebar in one embodiment can also be utilized in any of the other embodiments with slight variations made to those embodiments.

In some embodiments, some or all of the tumblers 6, 106, 206, 306, 406, 506, 606, 706 can be turned over and/or rotated to be employed as a second or different set of tumblers 7, 107, 207, 307, 407, 507, 607, 707. In such embodiments, the tumblers in both sets can be identical in shape and in structure, thereby reducing the number of different parts employed in the lock assembly and the manufacturing costs of the lock assembly.

Yet another example of the various changes that fall within the spirit and scope of the present invention relates to the tumblers. Although various embodiments of the present invention discussed herein refer to portions of the tumblers in terms of key-engaging elements, housing-engaging elements, sidebar-engaging elements, and the like, these terms are not limiting upon the scope of the appended claims not referring to such engagement or contact between the tumblers and the key, sidebar, and housing. The tumbler elements of the present invention can engage other elements and serve other functions. For example, some of the embodiments of the present invention employ tumbler elements for reading the coding of a key, and tumbler elements for performing a locking function by bridging a shear line between the barrel and the housing. However, neither of these functions are limited to a particular tumbler portion. Rather, as will be discussed briefly below, the "key-engaging elements" can perform many of the same functions as the "sidebar-engaging elements" and the "housing-engaging elements." Similarly, the other tumbler elements described herein can be adapted to perform one or more of the other tumbler element functions also described herein.

By way of example only, and with reference to FIG. 11E, the key-engaging element 7 can be altered to also engage the housing in a manner similar to the housing-engaging element 4. One such modification could include attaching the curved arm 52 of the housing-engaging element 4 (which is shown out of the plane of the cross-section) to the key-engaging element 7 rather than or in addition to the housing-engaging element 4. Thus, the "key-engaging element" would engage the coded surface of the key and engage the housing in the locked position, while the "housing-engaging element" could serve a primary purpose of holding the code of the lock. However, the "housing-engaging element" could still engage the housing even without curved arm 52 when an incorrect key is inserted in the lock. In such a case, the portion of the housing-engaging element labeled 32 (in FIG. 11A) would extend into the housing to prevent rotation of the barrel.

Another example of the possible modified functions of the tumbler elements described herein will be discussed with regard to FIG. 18. The key-engaging element 306 of this embodiment can also be modified to prevent rotation of the barrel with respect to the housing. As illustrated, the key-engaging element 306 has a generally U-shaped configuration. Either of the ends of the U-shape could be extended to engage the housing in the locked position. Alternatively, the bar 370 could be replaced with a conventional sidebar. As such, the sidebar and the "key-engaging element" 306 could have projection/recess engagement discussed above to control the position of the sidebar. In such an arrangement, the "key-engaging element" would also be a "sidebar-engaging element."

The tumbler element variations just described are but a few of the many possible variations of the illustrated embodiments that fall within the spirit and scope of the present invention. For example, a limited number of alternatives are provided above with regard to certain embodiments of the present invention. However, the variations discussed above have applications in the other embodiments of the present invention presented herein.

Although the embodiments of the present invention illustrated in FIGS. 1–34 are described above with reference to their use in vehicular applications, it will be appreciated that such lock assemblies can be employed in a number of other applications. By way of example only, lock assemblies according to the present invention can be employed to lock building or house doors, enclosures, cabinets, safes, and the like.

We claim:

1. A vehicular lock operable by a coded key and having an uncoded state in which the lock is not coded to the key and a coded state in which the lock is coded to the key, the coded state having a locked condition in which the key is not in the lock and an unlocked condition in which the key is in the lock, the vehicular lock comprising:

a housing;

a barrel located at least partially within the housing and selectively rotatable with respect to the housing;

a sidebar located at least partially within the barrel and selectively engagable with the housing to prevent rotation of the barrel with respect to the housing, the sidebar having an engaged position with respect to the housing in which the sidebar prevents the barrel from rotating and a disengaged position with respect to the housing in which the sidebar does not prevent the barrel from rotating; and a plurality of tumblers having a first tumbler portion and a second tumbler portion, the first portion moveable by a key inserted in the lock, the second portion movable into engagement with the first portion, at least one of the first tumbler portions and second tumbler portions movable with respect to another of the first tumbler portions and the second tumbler portions in the uncoded state of the lock and coupled for movement in the coded state of the lock, wherein the first tumbler portions have one of a projection extending away from a side of the first tumbler portion and elongated aperture extending along the first tumbler portion, the second tumbler portion having the other of a projection extending away from the side of the second tumbler portion and an elongated aperture adapted to receive a projection, at least one of the projection and aperture having serrations, the first tumbler portion movable with respect to the second tumbler portion in the uncoded state of the lock and coupled for movement in the coded state of the lock.

2. A vehicular lock operable by a coded key and having an uncoded state in which the lock is not coded to the key and a coded state in which the lock is coded to the key, the coded state having a locked condition in which the key is not in the lock and an unlocked condition in which the key is in the lock, the vehicular lock comprising:

a housing;

a barrel located at least partially within the housing and selectively rotatable with respect to the housing;

a sidebar located at least partially within the barrel and selectively engagable with the housing to prevent rotation of the barrel with respect to the housing, the sidebar having an engaged position with respect to the housing in which the sidebar prevents the barrel from rotating and a disengaged position with respect to the housing in which the sidebar does not prevent the barrel from rotating;

a plurality of tumblers having a first tumbler portion and a second tumbler portion, the first portion moveable by a key inserted in the lock, the second portion movable into engagement with the first portion, at least one of the first tumbler portions and second tumbler portions movable with respect to another of the first tumbler portions and the second tumbler portions in the uncoded state of the lock and coupled for movement in the coded state of the lock; and a cartridge adjacent to the housing and coupled to the barrel, the cartridge at least partially containing the sidebar and the second tumbler portion in the uncoded state of the lock, the sidebar moveable within the cartridge between a first position partially extending from the cartridge to a second position substantially within the cartridge.

3. The lock as claimed in claim 2, wherein the cartridge has an apertured wall, the second tumbler portions movable through the apertured wall during the transition of the lock from the uncoded state to the coded state as the sidebar exerts force upon the second tumbler portion towards the first tumbler portion.

4. The lock as claimed in claim 2, further comprising at least one spring within the cartridge, the at least one spring positioned to bias the sidebar into the second position of the sidebar when the key is inserted in the lock.

5. A vehicular lock operable by a coded key and having an uncoded state in which the lock is not coded to the key and a coded state in which the lock is coded to the key, the coded state having a locked condition in which the key is not in the lock and an unlocked condition in which the key is in the lock, the vehicular lock comprising:

a housing;

a barrel located at least partially with the housing and selectively rotatable with respect to the housing; and a plurality of tumblers having a first tumbler portion and a second tumbler portion, the first and second portions movable with respect to one another in the uncoded state of the lock, the first and second portions engaged with one another for movement together in the coded state of the lock, the first and second portions resistant to disconnection from one another in a direction substantially away from one another when engaged together;

wherein the first tumbler portion has a projection having serrations extending away from a portion of the side of the first tumbler portion and the second tumbler portion has an elongated aperture having serrations adapted to receive the projection.

6. A vehicular lock operable by a coded key and having an uncoded state in which the lock is not coded to the key and a coded state in which the lock is coded to the key, the coded state having a locked condition in which the key is not in the lock and an unlocked condition in which the key is in the lock, the vehicular lock comprising:

a housing;

a barrel located at least partially with the housing and selectively rotatable with respect to the housing;

a plurality of tumblers having a first tumbler portion and a second tumbler portion, the first and second portions movable with respect to one another in the uncoded state of the lock, the first and second portions engaged with one another for movement together in the coded state of the lock, the first and second portions resistant to disconnection from one another in a direction substantially away from one another when engaged together;

a sidebar located at least partially within the barrel and selectively engagable with the housing to prevent rotation of the barrel with respect to the housing, the sidebar having an engaged position with respect to the housing in which the sidebar prevents the barrel from rotating and a disengaged position with respect to the housing in which the sidebar does not prevent the barrel from rotating; and a cartridge adjacent to the housing and coupled to the barrel, the cartridge at least partially containing the sidebar and the second tumbler portions in the uncoded state of the lock, the cartridge having an apertured wall, the second tumbler portions movable through the apertured wall and towards the first tumbler portions during the coding process via a force from the sidebar as the sidebar moves from the engaged position to the disengaged position.

7. A method of coding a vehicular lock, comprising:

inserting a key into a barrel of the lock;

moving a first tumbler portion responsive to insertion of the key into the barrel of the lock;

rotating the key and the barrel with respect to a housing;

sliding a sidebar against an inner surface of the housing;

forcing the sidebar into the barrel responsive to sliding the sidebar against the inner surface of the housing;

moving a second tumbler portion towards the first tumbler portion responsive to forcing the sidebar into the barrel;

inserting a portion of one of the first tumbler portion and the second tumbler portion into an aperture in the other of the first tumbler portion and the second tumbler portion;

wherein inserting a portion of one of the first tumbler portion and the second tumbler portion into an aperture in the other of the first tumbler portion and the second tumbler portion comprises inserting a projection into an aperture to set a code of the tumbler; and interlocking serrations on the projection with serrations in the aperture.

8. A method of coding a vehicular lock, comprising:

inserting a key into a barrel of the lock;

moving a first tumbler portion responsive to inserting the key into the barrel of the lock;

moving a second tumbler portion towards the first tumbler portion;

inserting a portion of one of the first tumbler portion and the second tumbler portion into an aperture in another of the first tumbler portion and the second tumbler portion;

coupling the first and second tumbler portions together via the portion and aperture to form an engagement; and securing the engagement against release in a direction away from the first tumbler portion;

wherein inserting a portion of one of the first tumbler portion and the second tumbler portion into an aperture in the other of the first tumbler portion and the second tumbler portion comprises inserting a projection into the aperture to set a code of the key; and interlocking serrations on the projection with serrations in the aperture.

* * * * *